United States Patent [19]

Ohta et al.

[11] 4,314,016

[45] Feb. 2, 1982

[54] ELECTROPHOTOGRAPHIC ELEMENT HAVING A BISAZO PHOTOCONDUCTOR

[75] Inventors: Masafumi Ohta; Mitsuru Hashimoto; Kyoji Tsutsui, all of Tokyo, Japan

[73] Assignee: Ricoh Co., Ltd., Tokyo, Japan

[21] Appl. No.: 158,436

[22] Filed: Jun. 11, 1980

[30] Foreign Application Priority Data

Jun. 20, 1979 [JP] Japan ..... 54-78346

[51] Int. Cl.[3] ..... G03G 5/06

[52] U.S. Cl. ..... 430/59; 430/72; 430/73; 430/79; 430/58

[58] Field of Search ..... 430/58, 59, 72, 73; 260/174, 190

[56] References Cited

U.S. PATENT DOCUMENTS

| | | | |
|---|---|---|---|
| 3,066,023 | 11/1962 | Schlesinger | 430/73 |
| 3,484,237 | 12/1969 | Shattuck et al. | 430/80 |
| 3,775,105 | 11/1973 | Kukla | 430/80 |
| 3,791,826 | 2/1974 | Cherry et al. | 430/65 |
| 3,820,989 | 6/1974 | Rule et al. | 430/74 |
| 3,824,099 | 7/1974 | Champ et al. | 430/58 |
| 3,837,851 | 9/1974 | Shattuck et al. | 430/59 |
| 3,850,630 | 11/1974 | Regensburger et al. | 430/58 |
| 3,871,882 | 3/1975 | Wiedemann | 430/59 |
| 3,877,935 | 4/1975 | Regensburger et al. | 430/58 |
| 3,879,200 | 4/1975 | Regensburger et al. | 430/58 |
| 3,887,366 | 6/1975 | Champ et al. | 430/31 |
| 3,888,665 | 6/1975 | Wiedemann | 430/59 |
| 3,894,868 | 7/1975 | Regensburger | 430/78 |
| 3,895,944 | 7/1975 | Wiedemann et al. | 430/59 |
| 3,898,084 | 8/1975 | Champ et al. | 430/31 |
| 3,904,407 | 9/1975 | Regensburger et al. | 430/58 |
| 3,928,034 | 12/1975 | Regensburger | 430/65 |
| 3,955,978 | 5/1976 | Rochlitz et al. | 430/59 |
| 3,963,779 | 6/1976 | Tsukahara et al. | 564/330 |
| 3,972,717 | 8/1976 | Wiedemann | 430/65 |
| 3,973,959 | 8/1976 | Rochlitz et al. | 430/58 |
| 3,977,870 | 8/1976 | Rochlitz | 430/59 |
| 3,989,520 | 11/1976 | Rochlitz | 430/58 |
| 3,996,049 | 12/1976 | Rochlitz | 430/59 |
| 3,997,342 | 12/1976 | Bailey | 430/58 |
| 4,018,607 | 4/1977 | Contois | 430/73 |
| 4,026,704 | 5/1977 | Rochlitz | 430/57 |
| 4,028,102 | 6/1977 | Rochlitz et al. | 430/58 |
| 4,052,210 | 10/1977 | Hectors | 430/72 |
| 4,115,116 | 9/1978 | Stolka et al. | 430/58 |
| 4,150,987 | 4/1979 | Anderson et al. | 430/58 |

FOREIGN PATENT DOCUMENTS

| | | | |
|---|---|---|---|
| 54-150128 | 5/1978 | Japan | 430/58 |

*Primary Examiner*—Richard L. Schilling
*Assistant Examiner*—John L. Goodrow
*Attorney, Agent, or Firm*—Blanchard, Flynn, Thiel, Boutell & Tanis

[57] ABSTRACT

An electrophotographic element utilizing as a charge generation material a disazo pigment having the following general formula:

where $R^1$ is hydrogen, chlorine, bromine, methyl, ethyl, methoxy, ethoxy, nitro, dimethylamino, diethylamino or phenyl; m and n are each an integer such as 1 or 2; and $R^2$ is hydrogen or chlorine.

24 Claims, 2 Drawing Figures

ELECTROPHOTOGRAPHIC ELEMENT HAVING A BISAZO PHOTOCONDUCTOR

BACKGROUND OF THE INVENTION a. Field of the Invention

The present invention relates to an electrophotographic element, and in particular to an electrophotographic element comprising, in successive layers: a substrate and a photosensitive layer including a charge transport material and a specific disazo pigment (which is employed as a charge generation material).

b. Description of the prior art

As light-sensitive materials which have long been utilized in electrophotographic elements, there are widely known inorganic light-sensitive materials such as amorphous selenium, selenium alloys, cadmium sulfide, zinc oxide, etc., poly-N-vinyl carbazole and its derivatives. Among them, the amorphous selenium and selenium alloys are universally put to practical use because of their exceedingly superior photoconductivity. However, the above recited materials are observed to be defective in the following points. That is, in the case of amorphous selenium, since its light sensitive wavelength region is limited to the blue region, it is scarcely sensitive to the red region. A plurality of methods have been proposed in order to widen its sensitivity to the long wave region. However, since the selection of the light sensitive wavelength region is subject to various limitations, the amorphous selenium is unable to display a sufficient sensitivity to the long wave light. In the case of utilizing zinc oxide or cadmium sulfide as a light-sensitive material, it is necessary to add various kinds of sensitizers in order that said zinc oxide or cadmium sulfide may serve for practical purposes since its own light sensitive wavelength region is limited, too.

While the poly-N-vinyl carbazole, universally known as organic photoconductive material, is abundant in superior abilities such as transparency, film forming ability, flexibility, hole transportability and the like, there can be observed deficiencies in that it is itself scarcely sensitive to 400 to 700 mm visible light wave lengths and so forth.

As a photosensitive element which has successfully overcome the above mentioned deficiencies, Japanese Patent Publication No. 10496/1975 discloses one utilizing a charge transfer complex consisting of poly-N-vinyl carbazole and 2,4,7-trinitrofluorenone.

In Japanese Patent Publication Nos. 5349/1970, 3168/1974, 14914/1975, 10982/1976, etc. are furthermore discussed photosensitive elements of the type which comprises, in successive layers; a charge generation layer formed of amorphous selenium or selenium alloy and a charge transport layer, each layer being allotted its own function.

Still further, the following different photosensitive elements of the type which comprises, in successive layers: a charge generation layer including a different kind of pigment and a charge transport layer, have hitherto been developed. U.S. Pat. No. 3,837,851 discloses a photosensitive element which comprises a charge generation layer and a charge transport layer including at least one tri-arylpyrazoline. In U.S. Pat. No. 3,850,630 is disclosed a photosensitive element which comprises a transparent charge transport layer and a charge generation layer including an indigo dye. U.S. Pat. No. 3,871,882 discloses a photosensitive element which comprises a perylene tetracarboxydiimide derivativecontaining charge generation layer and a charge transport layer including a condensate of 3-bromopyrene-formaldehyde resin. Some of the above mentioned photosensitive elements have already been commercially available. However, the fact is that there have not been developed yet photosensitive elements capable of satisfying various proposed properties in full degree.

SUMMARY OF THE INVENTION

We have carried on various studies and discovered that a compound having the general formula, which will be referred to afterwards, works effectively when utilized as the charge generation material in electrophotographic elements. The present invention has been completed on the basis of this discovery.

It is a primary object of the present invention to provide a charge generation material capable of exhibiting a superior sensitivity to the short wave length side and thus provide an electrophotographic element which can exhibit a superior reproducibility in the visible light region.

In other words, the electrophotographic element according to the present invention may be said to be characterized by the provision of a photosensitive layer on a substrate, the former layer including a charge transport material and a disazo pigment having the general formula as mentioned below:

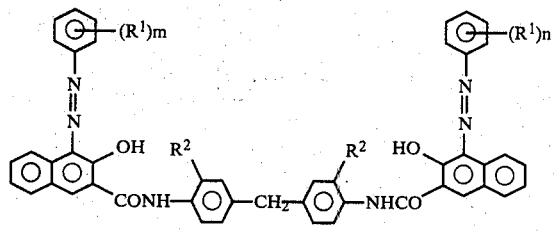

where $R^1$ is hydrogen, chlorine, bromine, methyl, ethyl, methoxy, ethoxy, nitro, dimethylamino, diethylamino or phenyl; m and n are each an integer such as 1 or 2; and $R^2$ is hydrogen or chlorine.

In this connection, it is to be noted that the disazo pigment referred to herein acts as the charge generation material.

DETAILED DESCRIPTION OF THE INVENTION

As mentioned previously, the element according to the present invention employs the disazo pigment having the above mentioned general formula as the charge generation material to be used therein. Some concrete examples of the aforesaid disazo pigment will be given as follows.

(1)

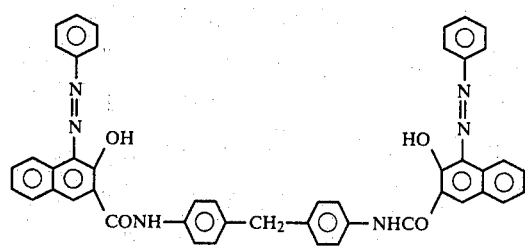

-continued
(2)
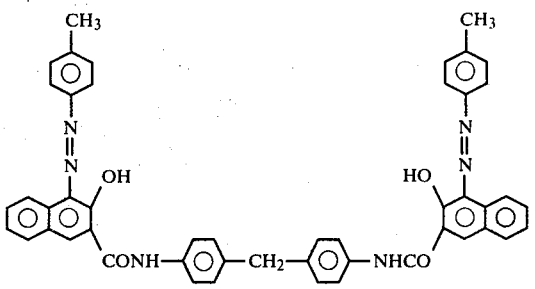
(3)
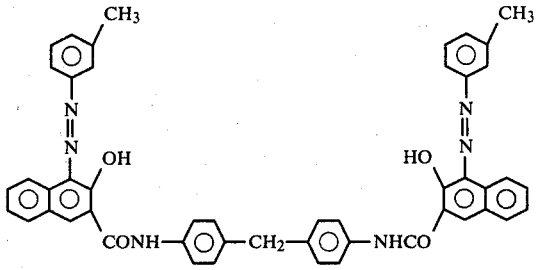
(4)
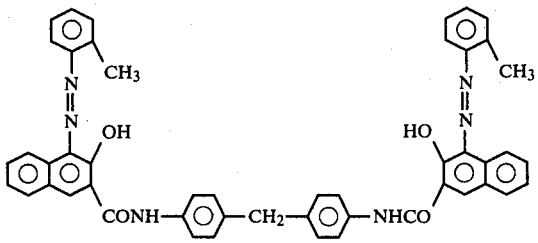
(5)
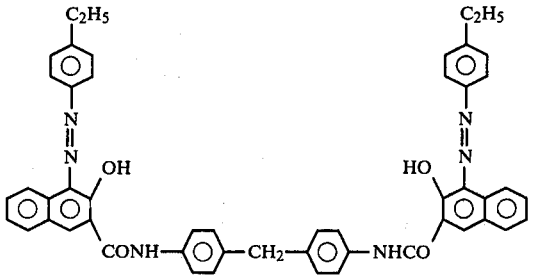
(6)
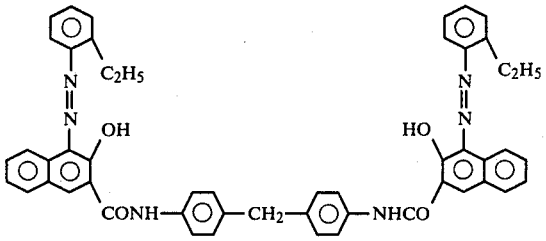
(7)
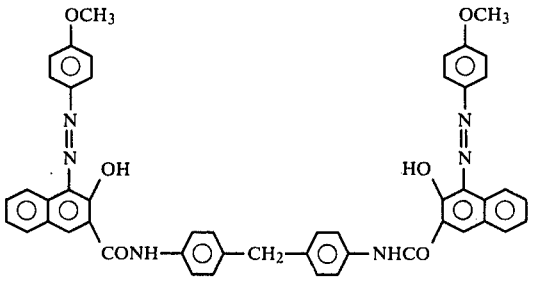
-continued
(8)
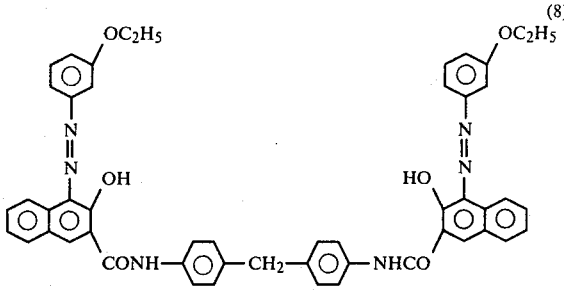
(9)
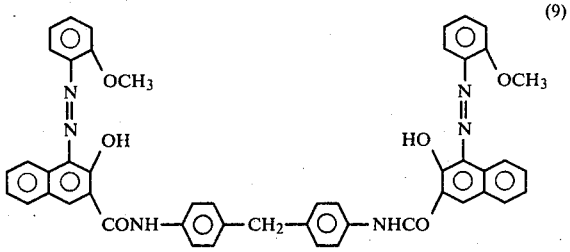
(10)
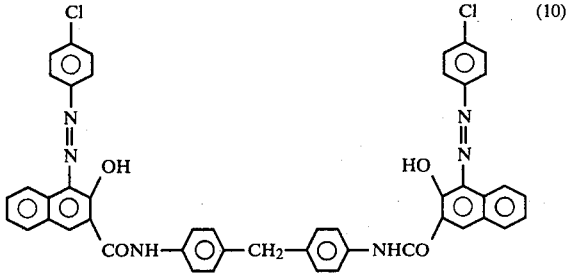
(11)
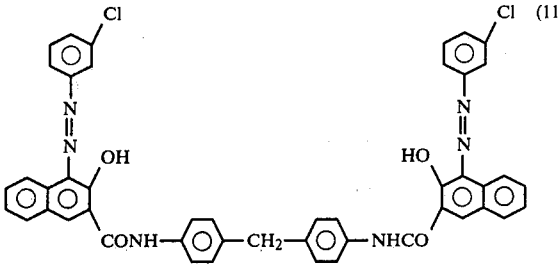
(12)
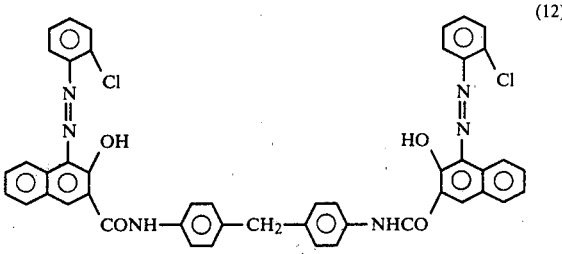
(13)
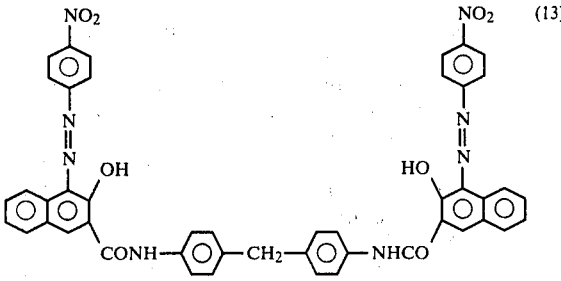

-continued
(14)
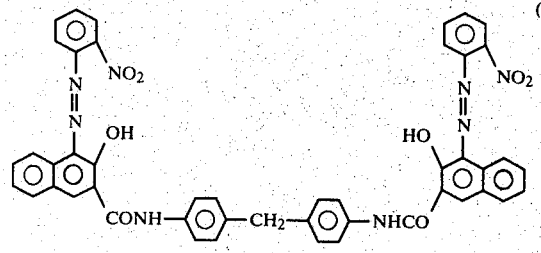
(15)
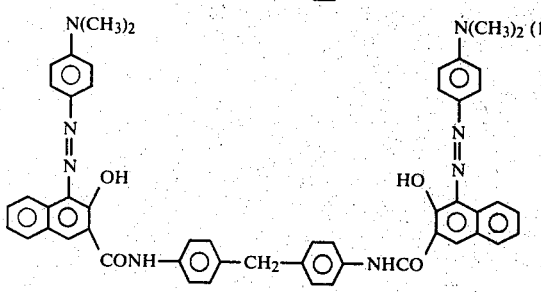
(16)
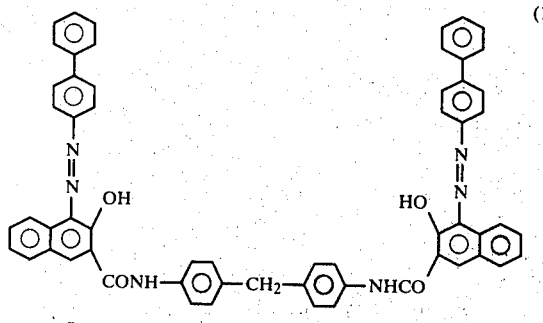
(17)
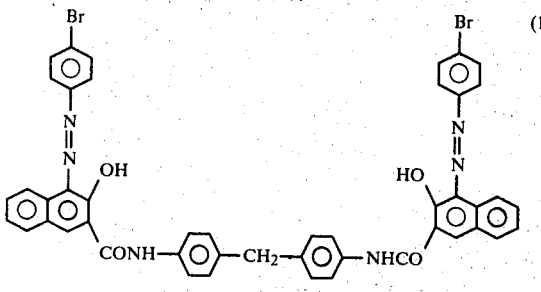
(18)
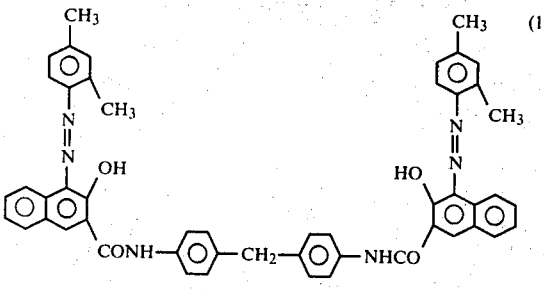
(19)
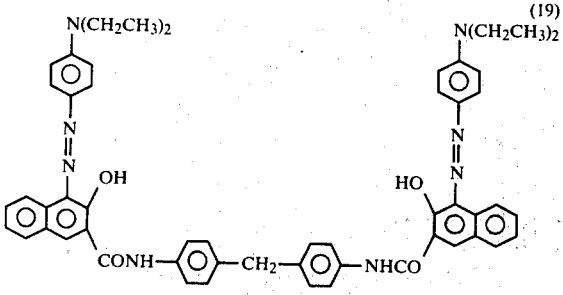
-continued
(20)
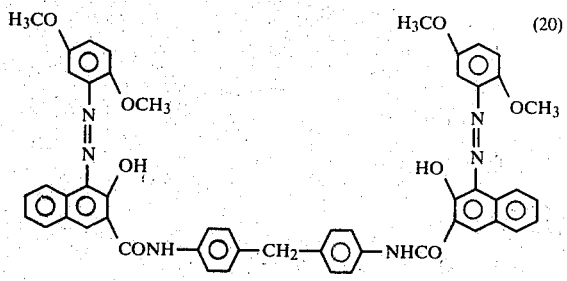
(21)
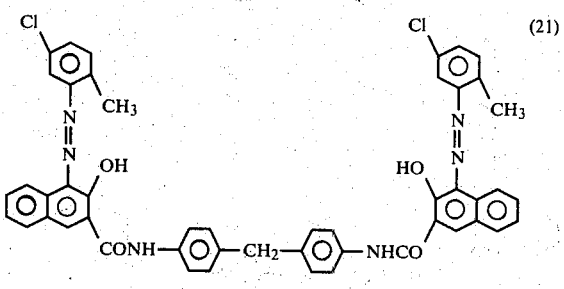
(22)
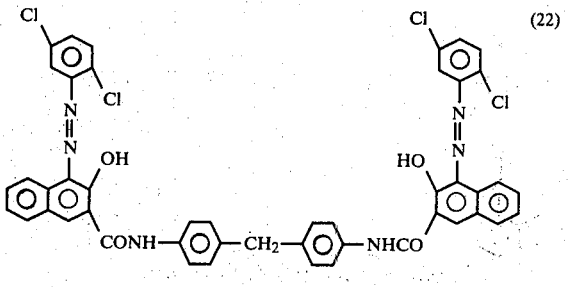
(23)
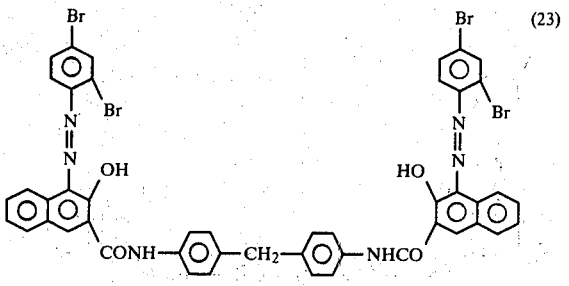
(24)
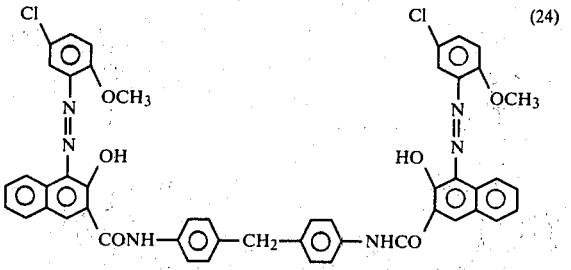
(25)
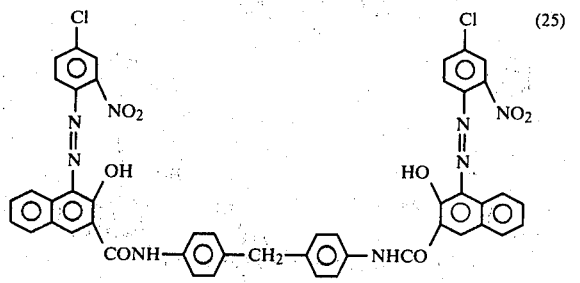

-continued
(26)
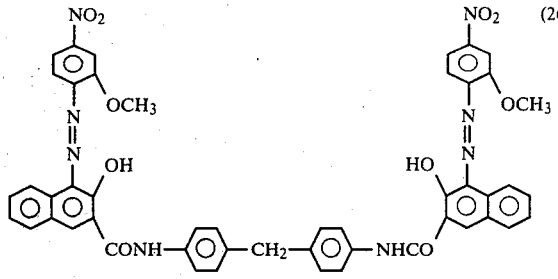
(27)
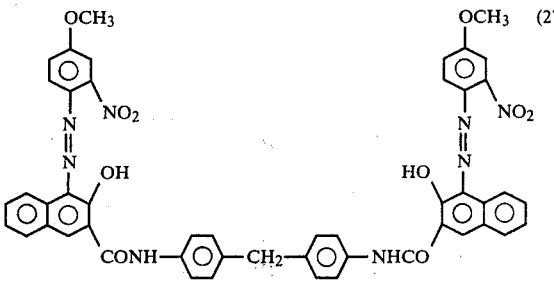
(28)
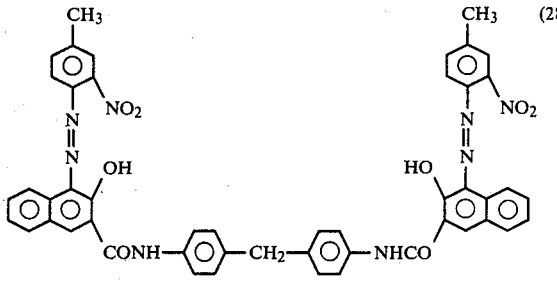
(29)
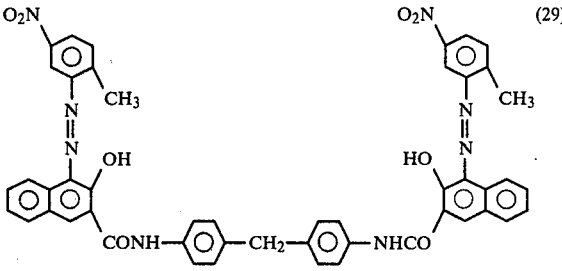
(30)
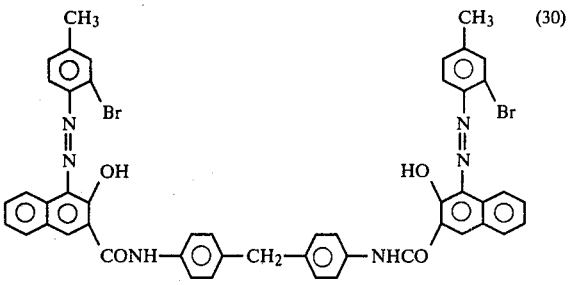
(31)
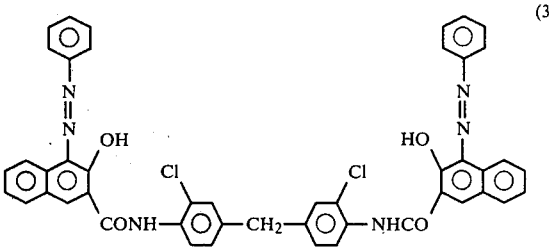
-continued
(32)
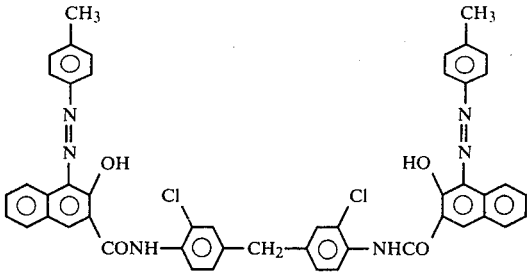
(33)
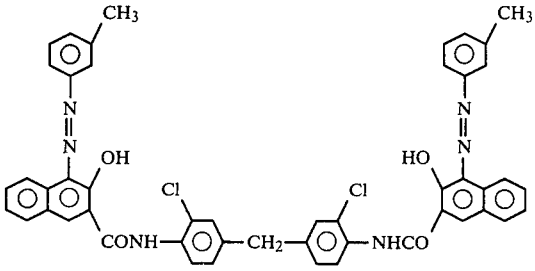
(34)
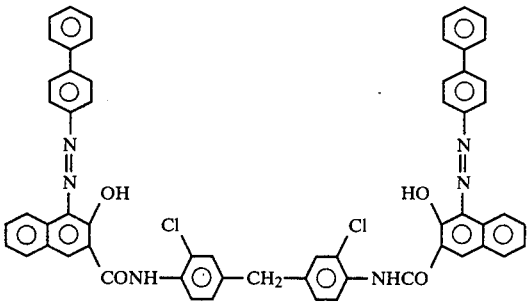
(35)
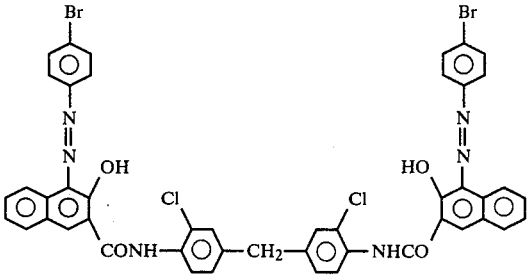
(36)
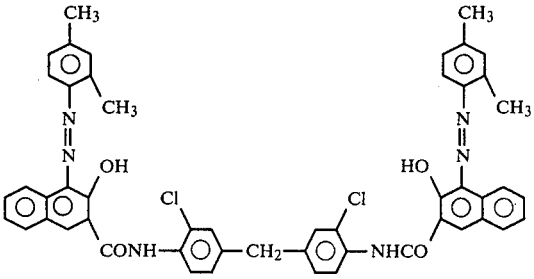
(37)
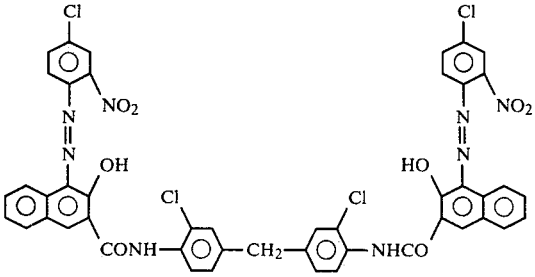

-continued
(38)
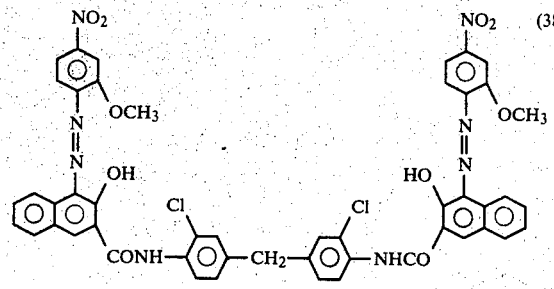
(39)
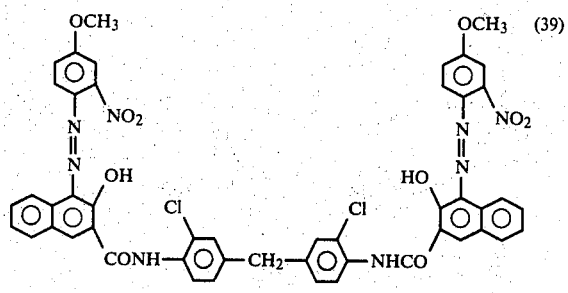
(40)
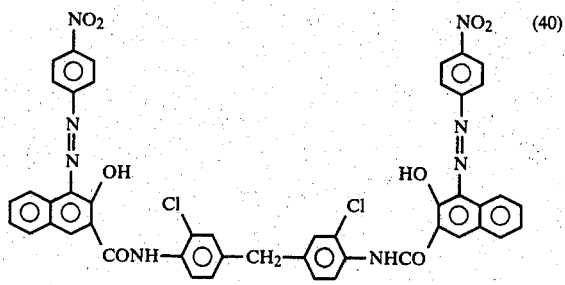
(41)
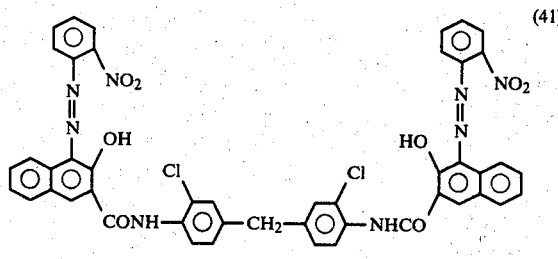
(42)
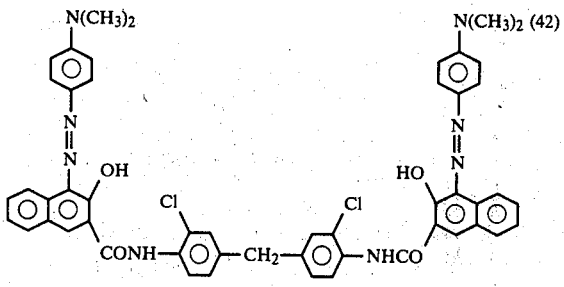
(43)
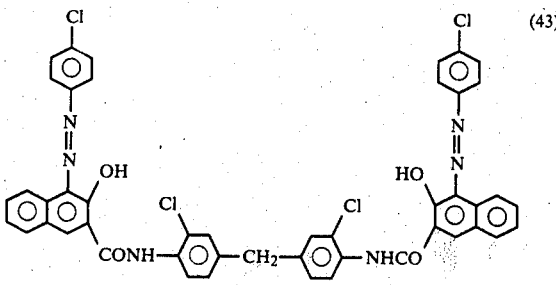
-continued
(44)
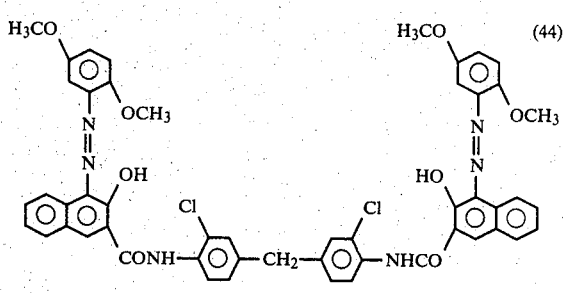
(45)
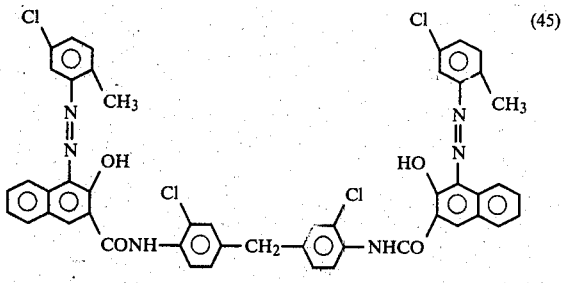
(46)
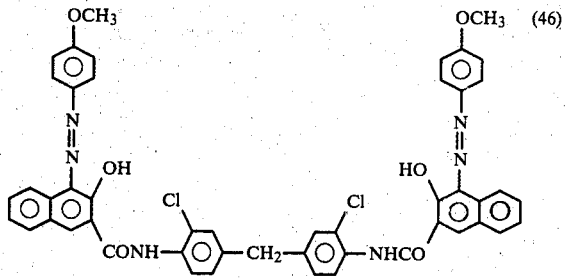
(47)
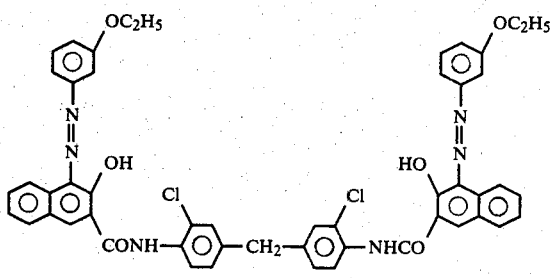
(48)
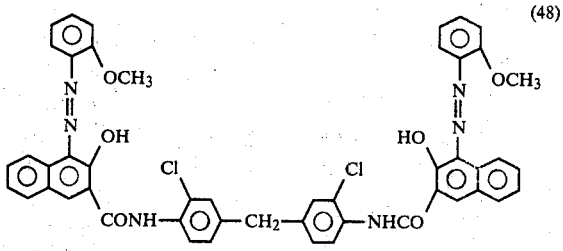
(49)
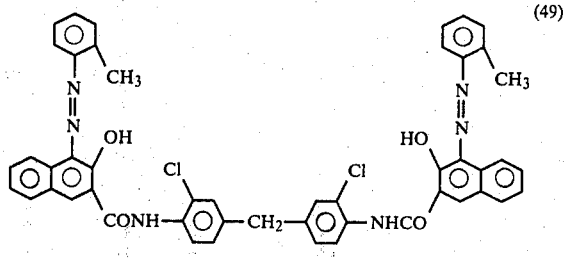

-continued
(50)
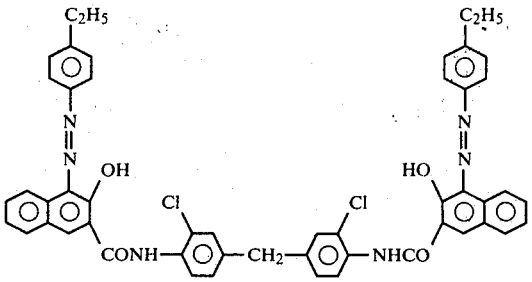
(51)
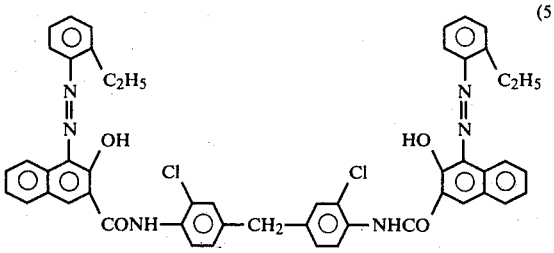
(52)
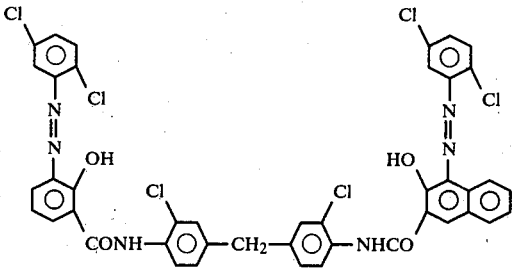
(53)
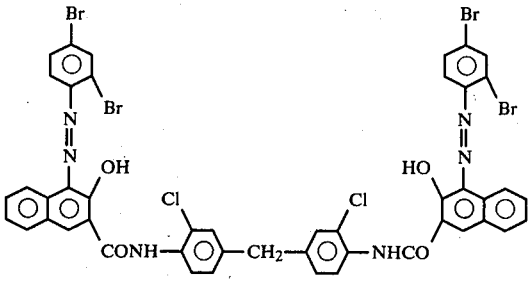
(54)
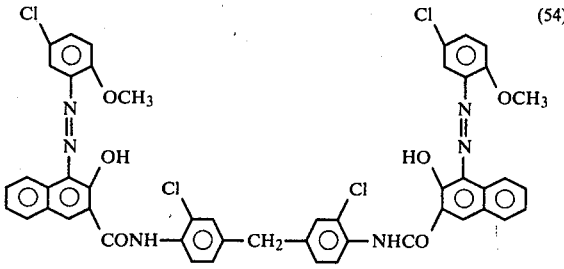
(55)
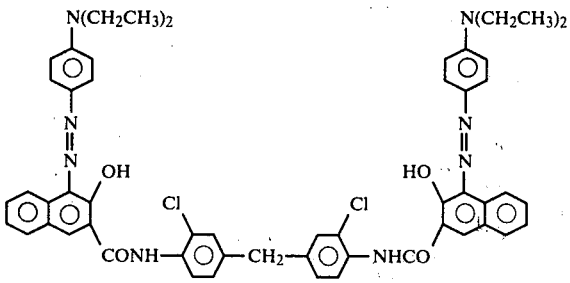
-continued
(56)
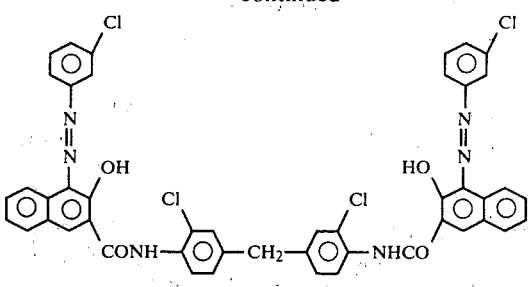
(57)
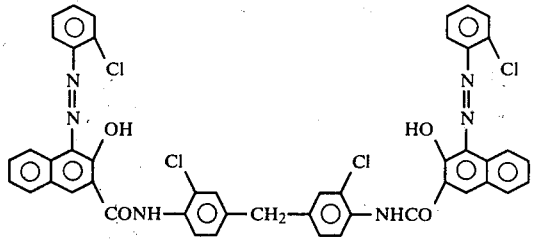
(58)
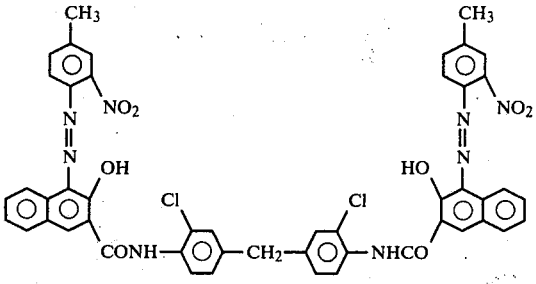
(59)
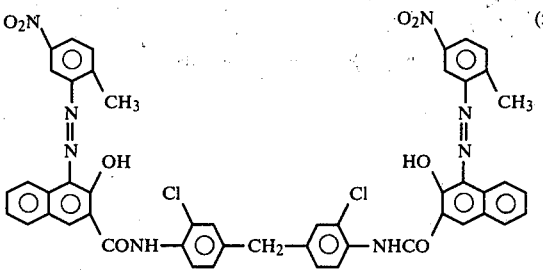
(60)
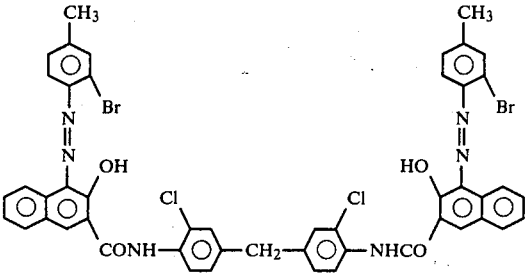
The disazo pigments as enumerated above can be readily obtained for instance by the condensation reaction of 1 mole of

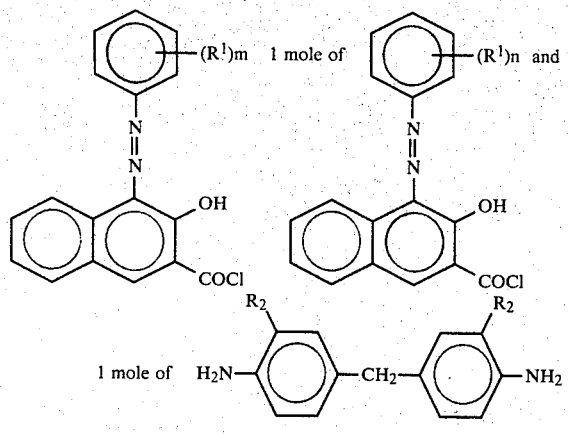

or the coupling reaction of 1 mole of

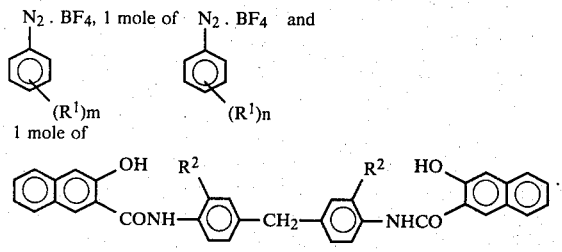

Among the above enumerated disazo pigments, those indicated as No. 1, No. 7, No. 10, No. 12, No. 13, No. 14, No. 31, No. 32, No. 34, No. 40, No. 41, No. 43, No. 44, No. 46, No. 49, No. 55, No. 56, No. 57 and No. 59 are preferably used, and from among them Nos. 46 and 49 are more preferably used with satisfactory results.

Figure 1:
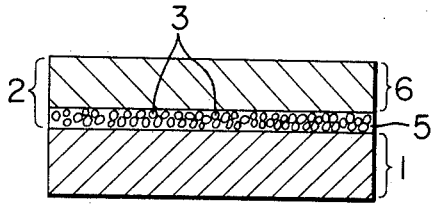
FIG. 1 is a sectional view of one embodiment of an electrophotographic element according to the invention.
Figure 2:
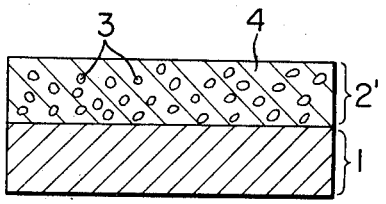
FIG. 2 is a sectional view of a second embodiment of an electrophotographic element according to the invention.

The electrophotographic element according to the present invention may take the form as illustrated in FIG. 1 or FIG. 2.

The element illustrated in FIG. 1 comprises, in successive layers; a conductive substrate 1, a charge generation layer 5 consisting essentially of a disazo pigment 3 and a charge transport layer 6 consisting essentially of a charge transport material.

In the element illustrated in FIG. 1, the element is exposed to light in an imagewise manner and said light passes through the charge transport layer and reaches the charge generation layer 5 thereby permitting the disazo pigment 3 at the light struck portions of the element to generate charges. On the other hand, the charges generated in the charge generation layer 5 are injected into the charge transport layer 6 and are transported therethrough. Accordingly, the element of the present invention may be said to have a mechanism so designed that the generation of charges required for light decay is made by the disazo pigment and the transport of the charges is made by the charge transport layer. In this regard, it is to be understood that in the case of the element referred to herein the relative position of the charge generation layer 5 to the charge transport layer 6 may be inverted.

The element illustrated in FIG. 2 comprises an electrically conductive substrate 1 and a photosensitive layer 2', superposed thereon, consisting essentially of a disazo pigment 3, a charge transport material 4 and an insulating binder. The disazo pigment referred to herein is likewise a charge generation material.

The element illustrated in FIG. 1 can be prepared by vacuum depositing the disazo pigment onto the electrically conductive substrate in accordance with the vacuum deposition methods disclosed in U.S. Pat. Nos. 3,973,959; 3,996,049; etc., or by coating, if need be, a dispersion of fine disazo pigment particles in a suitable solvent containing a binder dissolved therein onto the electrically conductive substrate and drying, and by coating, if further need be, a solution containing a charge transport material and a binder onto the electrically conductive substrate after surface finishing or film-thickness controlling by virtue of the buffing as disclosed, for instance, in Japanese Laid-open Patent Application No. 90827/1976 or the like and drying.

The element illustrated in FIG. 2 may be prepared by dispersing fine disazo pigment particles in a solution having a charge transport material and a binder dissolved therein, coating the resulting dispersion onto an electrically conductive substrate and drying. It is to be noted that in each case the disazo pigment utilized in the present invention is pulverized by means of a ball mill or the like so as to have a particle size of 5μ or less, preferably 2μ or less. The coating is effected by utilizing the conventional methods, for instance, such as doctor blade coating, dip coating, wire bar coating or the like.

Reference will be made to the thickness of the photosensitive layer. The photosensitive layer of FIG. 1 is between 0.01μ to 5μ preferably between 0.05μ to 2μ. When this thickness is less than 0.01μ charges are generated in an insufficient degree, while when said thickness is over 5μ the residual potential is too high for practical use. Referring to the thickness of the charge transport layer, it is between 3μ to 50μ, preferably between 5μ to 20μ. When this thickness is less than 3μ electricity is not charged in a sufficient degree, while when said thickness is more than 50μ the residual potential is too high for practical use. And the percentage of the charge transport material contained in the charge transport layer is between 10 to 95% by weight, preferably between 30 to 90% by weight. When the percentage of the charge transport material occupying the charge transport layer is less than 10% by weight the transport of charges does scarcely take place, while if said percentage is more than 95% by weight the element can not be put to practical use because its film is extremely deteriorated in mechanical strength. And, the percentage of the disazo pigment contained in the charge generation layer 5 is between 30 to 100% by weight, preferably between 50 to 100% by weight.

On the other hand, in the element of FIG. 2 the thickness of the photosensitive layer 2' is between 3 to 50μ, preferably 5 to 20μ. Preferably, the amount of the disazo pigment 3 contained in the photosensitive layer 2' is between 0.1 to 50% by weight and the amount of the charge transport material 4 contained therein is between 30 to 90% by weight. When said amounts deviate from the above defined ranges, the generation and transport of charges are likely to be out of order.

In this regard, it is to be noted that plasticizers may be employed in conjunction with binders in the preparation of either of the elements of FIGS. 1 and 2.

As the electrically conductive substrates appropriately used for the element of the present invention there can be enumerated metal plates of aluminum, copper, zinc, etc.; plastic sheets of polyester, etc.; plastic films having deposited thereon conductive substances such as aluminum, $SnO_2$, etc.; or electroconductively treated papers, etc.

As the binders appropriate for the present invention there can be enumerated condensation resins such as polyamide resins, polyurethane resins, polyester resins, epoxy resins, polyketone resins, polycarbonate resins, etc.; vinyl polymers such as polyvinylketone, polystyrene, poly-N-vinylcarbazole, polyacrylamide, etc.; and the like. However, it is to be noted that any insulating and adhesive resins can be appropriately used for the present invention. In practical instances, however, it is preferable that a suitable binder should be selected. Now, taking the case of the multilayer electrophotographic element illustrated in FIG. 1, the particularly preferred binders for use in the charge generation layer 5 are polyvinyl acetal, polyacrylates (polymethylmethacrylate) and the like. And, the particularly preferred binders for use in the charge transport layer 6 are polycarbonate resins, polyester resins, polystyrene and the like.

As the plasticizers appropriate for the present invention there can be enumerated halogenated paraffin, polychlorobiphenyl; dimethylnaphthalene, dibutyl phthalate, etc. Silicone oil and the like may be added in order to further improve the surface smoothness of the element.

As particular preferred charge transport materials, furthermore, there can be numerated polymers, namely, vinyl polymers such as poly-N-vinyl carbazole, polyvinyl indoloquinoxaline, polyvinyldibenzothiophene, polyvinyl anthracene, polyvinyl acridine, etc. and condensation resins such as bromopyrene~formaldehyde resin, ethylcarbazole~formaldehyde resin, etc.; and monomers such as 2,4,7-trinitro-9-fluorenone, 2,6,8-trinitro-4H-indeno[1,2-b] thiophene-4-one, 2,8-dinetrodibenzothiophene, 1,3,7-trinitrodibenzothiophene-5,5-dioxide, 1,3,7,9-tetranitrobenzo[c]cinnoline-5-oxide, 2,4,8-trinitrothioxanthone, 1-bromopyrene, N-ethylcarbazole, 2-phenylindole, 2-phenylnaphthalene, 2,5-bis(4-diethylaminophenyl)-1,3,4-oxadiazole, 2,5-bis(4-diethylaminophenyl)-1,3,4-triazole, 1-phenyl-3-(4-diethylaminostyryl)-5-(4-diethylaminophenyl)pyrazoline, 2-phenyl-4-(4-diethylaminophenyl)-5-phenyloxazole, triphenylamine, tris(4-diethylaminophenyl)methane, 3,6-bis(dibenzylamino)-9-ethylcarbazole, etc. These charge transport materials may be used singly or in a combination of two or more members. The most preferred charge transport material varies depending on the kinds of disazo pigments used. Although the reason is unknown, the most preferable electrophotographic element is in fact produced by combining a certain kind of disazo pigment with a certain kind of charge transport material.

As some of the particularly suitable charge transport materials for use in the disazo pigments of the present invention, there may be enumerated, for instance, the following four materials (Nos. 61 through 64):

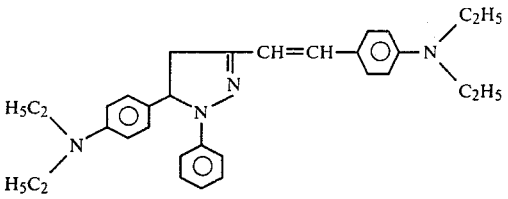
(61)

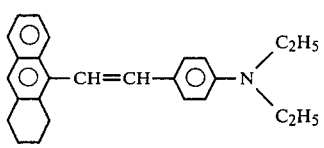
(62)

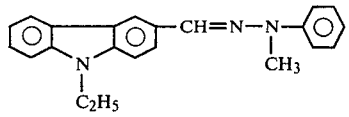
(63)

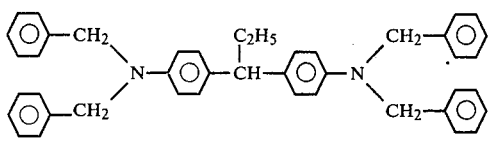
(64)

In this context, it is to be noted that in each of the electrophotographic elements obtained as aforesaid, an adhesive layer or a barrier layer may be interposed between the electrically conductive substrate and the photosensitive layer as occasion demands. The preferred materials for this adhesive or barrier layer include polyamide, nitrocellulose, aluminum oxide and the like, and said layer is preferable to be 1μ or less thick.

The reproduction using the element of the present invention is achieved by electrifying the surface of the photosensitive layer of the element, exposing the same to light, then developing and if needed, transferring to paper or the like.

The electrophotographic element according to the present invention is exceedingly advantageous in that it is highly sensitive to the short wave length side, is of a very abundant flexibility and so forth. More concretely, almost all the disazo pigments of the present invention have an absorption wavelength region in the range of 600 nm or less (less than 600 nm).

DESCRIPTION OF THE PREFERRED EMBODIMENTS

In this context, it is to be noted that every part is by weight.

EXAMPLE 1

Two parts of No. 16 disazo pigment and 98 parts of tetrahydrofuran were pulverized in a ball mill for mixing. The resulting dispersion was coated onto an aluminized polyester film by means of a doctor blade and air-dried to thereby form an about 1μ thick charge generation layer. On the other hand, 2 parts of 9-(4-diethylaminostyryl) anthracene and 2 parts of polycarbonate resin (Panlite L available from TEIJIN K.K.) were dissolved in 16 parts of tetrahydrofuran. The resulting solution was coated onto said charge generation layer by means of a doctor blade and the same was dried at 120° C. for 10 minutes, thereby forming an about 11μ-thick charge transport layer. The multilayer electrophotographic element of FIG. 1 was thus prepared.

Next, the surface of the photosensitive layer of this element was subjected to −6 KV corona discharge for 20 seconds by means of a commercially available electrostatic copying paper analyser tester for negative charge, and then was left to stand in the dark for 20 seconds, and then measuring the surface potential Vpo (volt) at that time. Successively, the photosensitive layer was exposed to radiation of light from a tungsten lamp so that the surface intensity may become 20 lux. Then, the time (second) required until the surface potential was decreased to one half of Vpo was calculated and named the half decay exposure time $T\frac{1}{2}$ (second). The results thus obtained showed that Vpo was 980 volts and $T\frac{1}{2}$ was 2.1 seconds.

Furthermore, the surface of the photosensitive layer was likewise charged negatively and left standing in the dark to thereby measure V'po (volt). Successively, the photosensitive layer was exposed to irradiation of light transmitted through a filter which blocked the passage of 620 nm or more of light, and the time (second) required until the surface potential was decreased to one half of V'po and named the half decay exposure time $T\frac{1}{2}$ (second). The results thus obtained showed that V'po was 980 volts and $T'\frac{1}{2}$ was 2.3 seconds. It is seen from the fact that $T'\frac{1}{2}/T\frac{1}{2}=1.10$ that this element has a superior sensitivity to the short wave length side.

Still further, copying was carried out with this element by means of a copying machine (P-500 available from RICOH K.K.) and the image densities of the black image area (Kodak.Gray scale 1.6) and the red image area (Kodak.Color Control Patches, primary red) were measured by means of a Macbeth densitometer:

| | |
|---|---|
| Black image area | 1.1 |
| Red image area | 0.7 |

Comparative Example 1

A multilayer electrophotographic element was prepared by a process entirely similar to that of Example 1 with the exception that chlorodiane Blue was employed in place of No. 16 disazo pigment. Then, the value $T'\frac{1}{2}/T\frac{1}{2}$ was calculated with this element: $T'\frac{1}{2}/T\frac{1}{2}=1.83$.

And, the image densities were measured according to the same procedure as described in Example 1:

| | |
|---|---|
| Black image area | 1.1 |
| Red image area | 0.4 |

It can be understood from this fact that the electrophotographic element using the charge generation material according to the present invention exhibits an excellent reproducibility in the red image area, too.

EXAMPLE 2

A multilayer electrophotographic element was prepared by a process entirely similar to that of Example 1 with the exception that No. 46 disazo pigment was employed in place of No. 16 disazo pigment, and the charge transport layer was formed to be about 10μ thick. This element was tested with the results: V'po, 940 volts; $T'\frac{1}{2}$, 1.9 seconds; $T'\frac{1}{2}/T\frac{1}{2}=1.06$; and image densities were measured as follows:

| | |
|---|---|
| Black image area | 1.1 |
| Red image area | 0.7 |

EXAMPLE 3

One part of No. 1 disazo pigment and 66 parts of tetrahydrofuran containing 0.5% polyester resin (Vylon 200 available from TOYOBO K.K.) were pulverized in a ball mill for mixing. The resulting dispersion was coated onto an aluminized polyester film by means of a doctor blade and dried at 80° C. for 2 minutes, thereby forming an about 0.7μ-thick charge generation layer. On the other hand, 2 parts of 1,1-bis(4-dibenzylaminophenyl) propane and 2 parts of polycarbonate resin (Panlite K-1300 available from TEIJIN K.K.) were dissolved in 16 parts of tetrahydrofuran. The resulting solution was coated onto said charge generation layer by means of a doctor blade and the same was dried at 120° C. for 10 minutes, thereby forming an about 13μ-thick charge transport layer. A multilayer electrophotographic element of FIG. 1 was thus prepared. This element showed $T'\frac{1}{2}/T\frac{1}{2}=1.03$.

And, a multilayer electrophotographic element was prepared by entirely the same process with the exception that No. 31 disazo pigment was employed in place of No. 1 disazo pigment. This element showed $T'\frac{1}{2}/T\frac{1}{2}=1.03$.

EXAMPLE 4 THROUGH 9

Multilayer electrophotographic elements of FIG. 1 were prepared through entirely the same process as Example 3 with the exception that the disazo pigments numbered as shown in the following Table-1 were employed in place of No. 1 disazo pigment. The value of $T'\frac{1}{2}/T\frac{1}{2}$ was measured in respect of each element according to the same procedure with the results as shown in Table-1.

TABLE-1

| Example | Disazo pigment | $T'\frac{1}{2}/T\frac{1}{2}$ |
|---|---|---|
| 4 | 4 | 1.06 |
| 5 | 7 | 1.09 |
| 6 | 19 | 1.40 |
| 7 | 34 | 1.08 |
| 8 | 37 | 1.06 |
| 9 | 49 | 1.09 |

EXAMPLE 10

Two parts of No. 5 disazo pigment and 70 parts of tetrahydrofuran were pulverized in a ball mill for mixing. The resulting dispersion was coated onto an aluminized polyester film by means of a doctor blade and air-dried, thereby forming an about 1.5μ-thick charge generation layer.

On the other hand, 2 parts of 1-phenyl-3-(4-diethylaminostyryl)-5-(4-diethylaminophenyl)pyrazoline and 3 parts of polystyrene (Topolex available from Mitsui Toatsu Kagaku K.K.) were dissolved in 17 parts of tetrahydrofuran. The resulting solution was coated onto said charge generation layer by means of a doctor blade and dried at 120° C. for 10 minutes to thereby form an about 16μ-thick charge transport layer. A multilayer electrophotographic element of FIG. 1 was thus prepared. Then, the value of $T'\frac{1}{2}/T\frac{1}{2}$ was calculated with this element according to the same procedure as Example 1, which showed the following result: $T'\frac{1}{2}/T\frac{1}{2}=1.13$.

EXAMPLE 11 THROUGH 19

Multilayer electrophotographic elements of FIG. 1 were prepared by entirely the same process as Example 10 with the exception that disazo pigments numbered as shown in the following Table-2 were employed in place of No. 5 disazo pigment. The value of $T'\frac{1}{2}/T\frac{1}{2}$ was measured in respect of each element according to the same procedure as described previously with the results shown in Table-2.

TABLE-2

| Example | Disazo pigment | $T'_{\frac{1}{2}}/T_{\frac{1}{2}}$ |
|---|---|---|
| 11 | 21 | 1.04 |
| 12 | 17 | 1.03 |
| 13 | 26 | 1.12 |
| 14 | 14 | 1.04 |
| 15 | 35 | 1.07 |
| 16 | 51 | 1.11 |
| 17 | 47 | 1.08 |
| 18 | 56 | 1.08 |
| 19 | 44 | 1.24 |

EXAMPLE 20

Two parts of No. 10 disazo pigment and 98 parts of tetrahydrofuran were pulverized in a ball mill for mixing. The resulting dispersion was coated onto an aluminized polyester film by means of a doctor blade and air-dried, thereby forming an about 1μ-thick charge generation layer. On the other hand, 2 parts of 9-ethyl-3-carbazolealdehyde-1-methyl-1-phenylhydrazone, 1 part of poly-N-vinylcarbazole (Luvican M-170 available from BASF A.G.) and 1 part of polyester resin (the same as Example 3) were dissolved in 18 parts of tetrahydrofuran. The resulting solution was coated onto said charge generation layer by means of a doctor blade and the same was dried at 120° C. for 10 minutes, thereby forming an about 16μ-thick charge transport layer. A multilayer electrophotographic element of FIG. 1 was thus prepared. Then, the value of $T'_{\frac{1}{2}}/T_{\frac{1}{2}}$ was measured with this element according to the same procedure as Example 1 with the result: $T'_{\frac{1}{2}}/T_{\frac{1}{2}}=1.08$.

And, a multilayer electrophotographic element was prepared by employing No. 40 disazo pigment in place of No. 10 disazo pigment. This element showed $T'_{\frac{1}{2}}/T_{\frac{1}{2}}=1.05$.

EXAMPLE 21 THROUGH 28

Multilayer electrophotographic elements of FIG. 1 were prepared by entirely same process as Example 20 with the exception that disazo pigments numbered as shown in the following Table-3 were employed in place of No. 10 disazo pigment. The value of $T'_{\frac{1}{2}}/T_{\frac{1}{2}}$ was measured in respect of each element according to the same procedure as described previously with the results as shown in Table-3.

TABLE-3

| Example | Disazo pigment | $T'_{\frac{1}{2}}/T_{\frac{1}{2}}$ |
|---|---|---|
| 21 | 9 | 1.21 |
| 22 | 15 | 1.36 |
| 23 | 12 | 1.10 |
| 24 | 23 | 1.13 |
| 25 | 39 | 1.10 |
| 26 | 45 | 1.14 |
| 27 | 42 | 1.33 |
| 28 | 53 | 1.20 |

EXAMPLE 29

Ten parts of polyester resin (the same as that of Example 3), 10 parts of 2,5-bis(4-diethylaminophenyl)-1,3,4-oxadiazole, 2 parts of No. 3 disazo pigment and 108 parts of tetrahydrofuran were pulverized in a ball mill for mixing. The resulting dispersion was coated onto an aluminized polyester film by means of a doctor blade and the same was dried at 120° C. for 10 minutes, thereby forming an about 21μ-thick photosensitive layer. An element of the type illustrated in FIG. 2 was thus prepared. The thus obtained element was measured through the same procedure as Example 1 with the exception that +6 KV corona discharge was employed. This element showed that $T'_{\frac{1}{2}}/T_{\frac{1}{2}}=1.19$.

EXAMPLE 30 THROUGH 38

Elements of the type illustrated in FIG. 2 were prepared by entirely the same process as Example 29 with the exception that disazo pigments numbered as shown in the following Table-4 were employed in place of No. 3 disazo pigment. The value of $T'_{\frac{1}{2}}/T_{\frac{1}{2}}$ was measured in respect of each element according to the same procedure as described previously with the results as shown in Table-4.

TABLE-4

| Example | Disazo pigment | $T'_{\frac{1}{2}}/T_{\frac{1}{2}}$ |
|---|---|---|
| 30 | 8 | 1.24 |
| 31 | 22 | 1.16 |
| 32 | 25 | 1.14 |
| 33 | 30 | 1.20 |
| 34 | 33 | 1.10 |
| 35 | 38 | 1.25 |
| 36 | 52 | 1.19 |
| 37 | 55 | 1.38 |
| 38 | 60 | 1.27 |

What is claimed is:

1. An electrophotographic element comprising;

an electrically conductive layer;

a charge generation layer on the electrically conductive layer, the charge generation layer having a thickness of from 0.01μ to 5μ and comprising particles of disazo pigment having a particle size of 5μ or less, said disazo pigment having the formula;

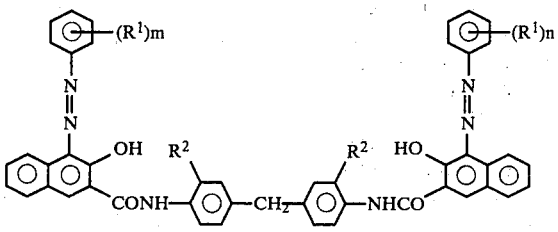

wherein $R^1$ is hydrogen, chlorine, bromine, methyl, ethyl, methoxy, ethoxy, nitro, dimethylamino, diethylamino or phenyl; m and n are each an integer of 1 or 2 and the $R^1$ groups are the same or different when m and n are 2; and $R^2$ is hydrogen or chlorine;

and a charge transport layer adjacent the charge generation layer, the charge transport layer having a thickness of from 3μ to 50μ and comprising a polymeric binder.

2. An electrophotographic element as set forth in claim 1 in which the charge generation layer comprises a disazo pigment selected from the group consisting of

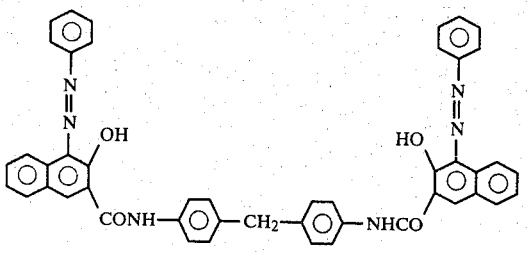
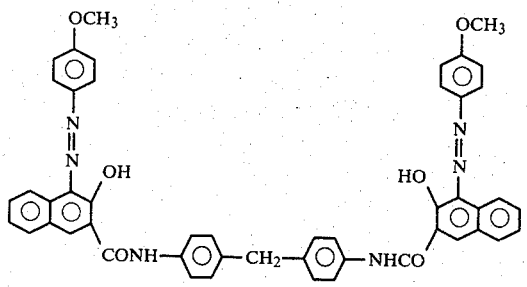
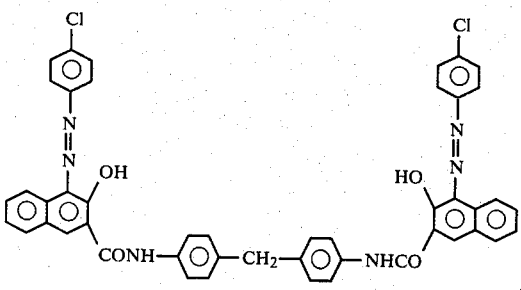
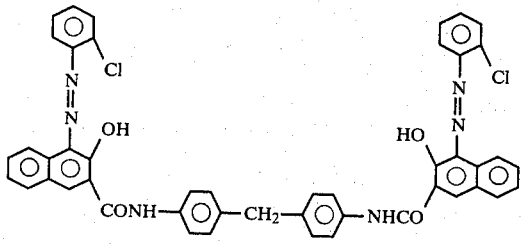
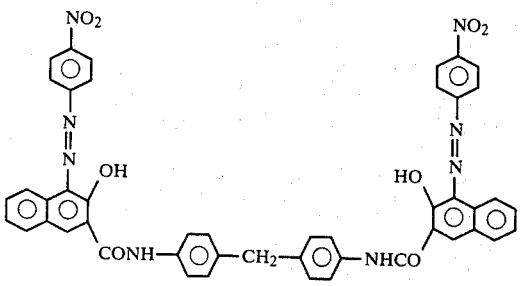
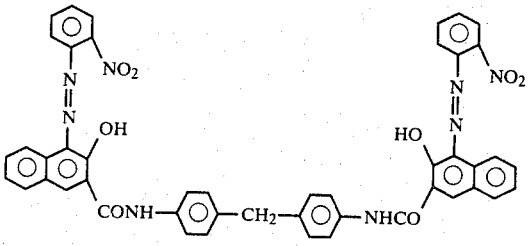
-continued
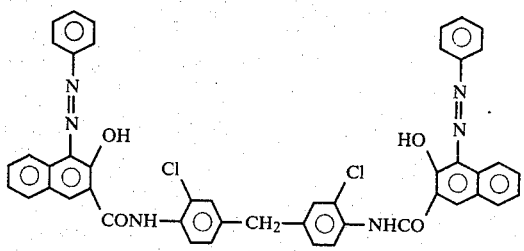
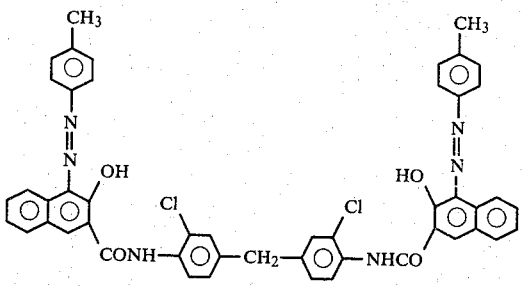
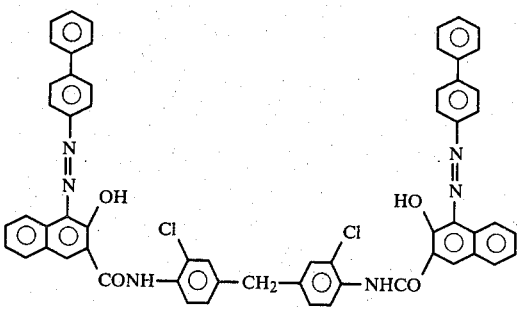
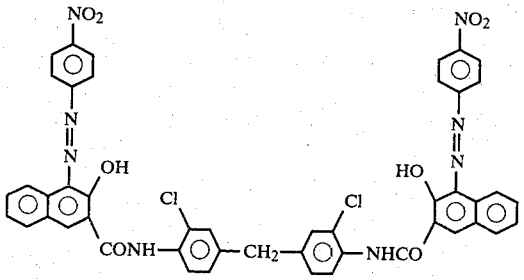
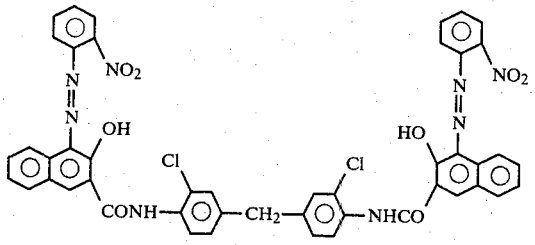
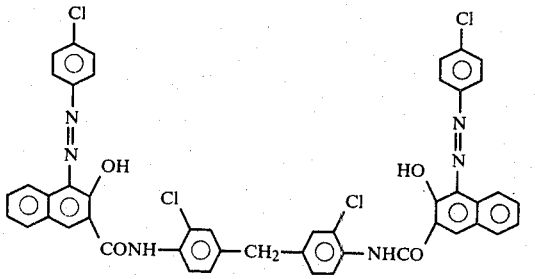

-continued

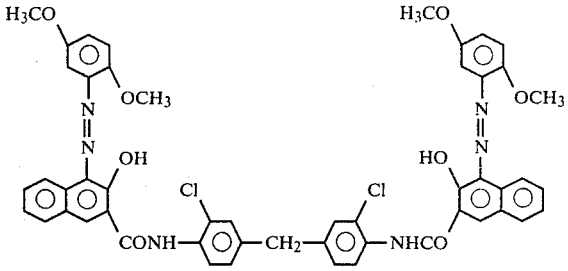

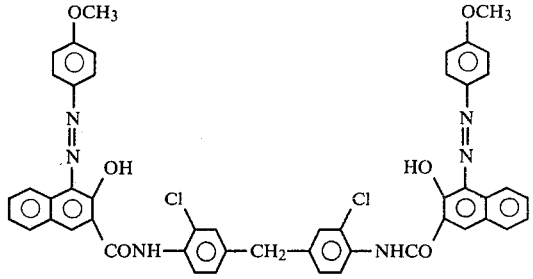

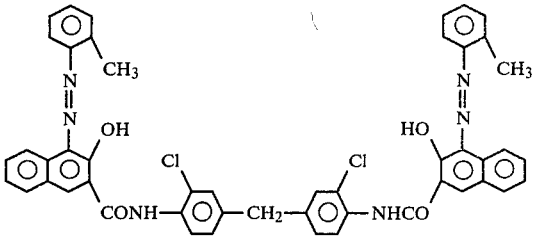

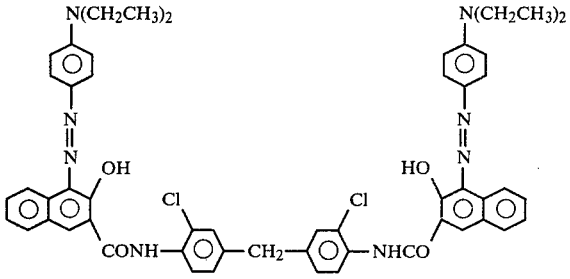

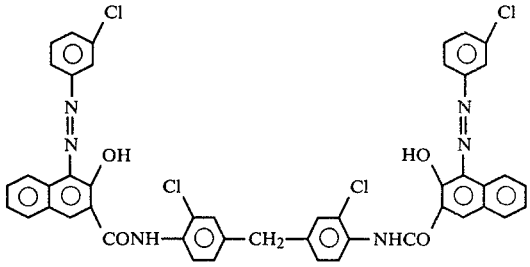

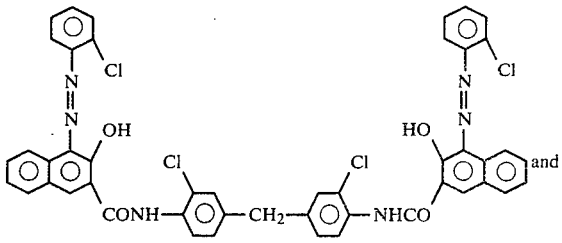

-continued

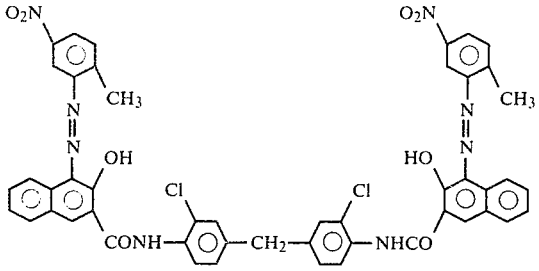

3. An electrophotographic element set forth in claim 1 in which the charge generation layer comprises a disazo pigment selected from the group consisting of

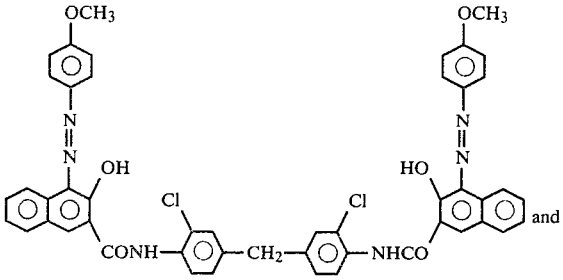

and

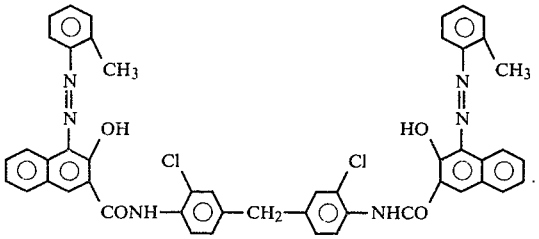

4. An electrophotographic element as set forth in claim 1 in which the charge generation layer is positioned between the electrically conductive layer and the charge transport layer, the charge transport layer forming an exposed surface of the electrophotographic element.

5. An electrophotographic element as set forth in claim 1 in which the charge transport layer comprises a compound selected from the group consisting of 9-(4-diethylaminostyryl)anthracene, 1,1-bis(4-dibenzylaminophenyl)propane, 1-phenyl-3-(4-diethylaminostyryl)-5-(4-diethylaminophenyl)pyrazoline and 9-ethyl-3-carbazolealdehyde-1-methyl-1-phenylhydrazone.

6. An electrophotographic element as set forth in claim 1 in which the polymeric binder is selected from the group consisting of polycarbonate resins, polystyrene, polyester resins, polyvinyl acetal, polyacrylates, polymethylmethacrylate and mixtures thereof.

7. An electrophotographic element as set forth in claim 1 in which said charge generation layer contains from 30 to 100% by weight of said disazo pigment and said charge transfer layer contains from 10 to 95% by weight of charge transport material.

8. An electrophotographic element comprising, in successive layers;

an electrically conductive substrate;

a charge generation layer responsive to actinic radiation of a wave length shorter than 6000 angstroms to generate an electronhole pair, the charge generation layer having a thickness of from 0.01$\mu$ to 5$\mu$ and being comprised of particles of a disazo pigment having a particle size of 5μ or less, said disazo pigment having the formula;

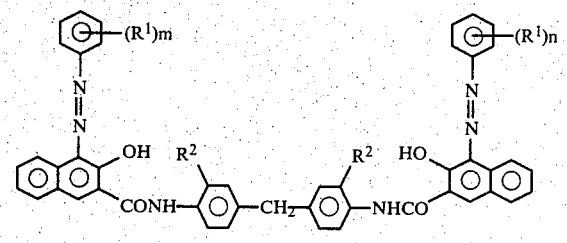

wherein $R^1$ is hydrogen, chlorine, bromine, methyl, ethyl, methoxy, ethoxy, nitro, dimethylamino, diethylamino or phenyl; m and n are each an integer of 1 or 2 and the $R^1$ groups are the same or different when m and n are 2; and $R^2$ is hydrogen or chlorine;

and a charge transport layer having a thickness of from 3μ to 50μ, the charge transport layer comprising a charge transport material selected from the group consisting of 9-(4-diethylaminostyryl) anthracene, 1,1-bis(4-dibenzylaminophenyl)propane, 1-phenyl-3-(4-diethylaminostyryl)-5-(4-diethylaminophenyl)pyrazoline and 9-ethyl-3-carbazolealdehyde-1-methyl-1-phenylhydrazone and a polymeric binder.

9. An electrophotographic element set forth in claim 8 in which the charge generation layer comprises a disazo pigment selected from the group consisting of

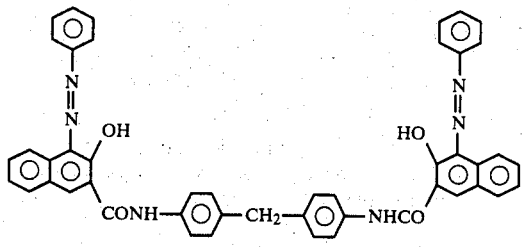

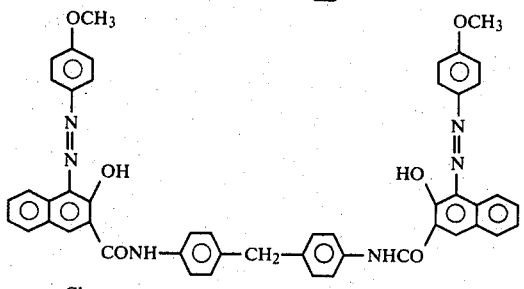

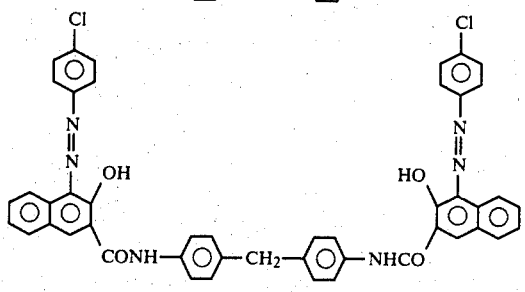

-continued

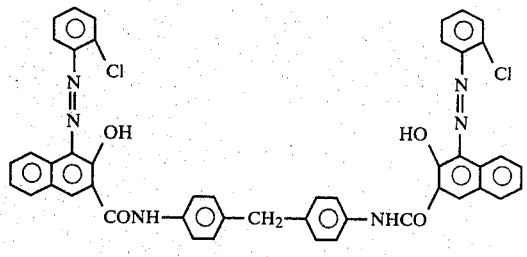

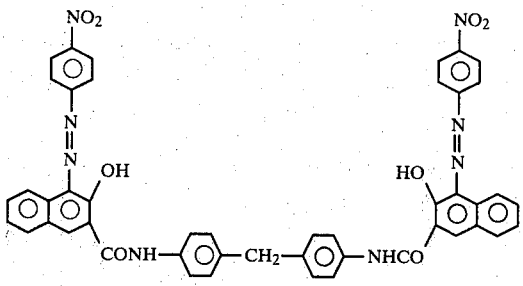

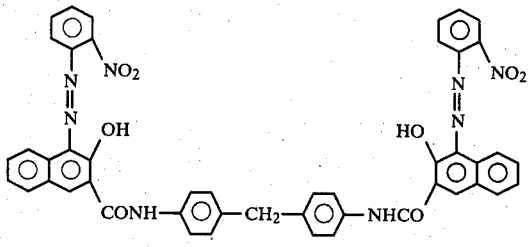

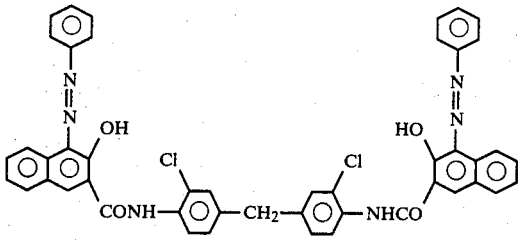

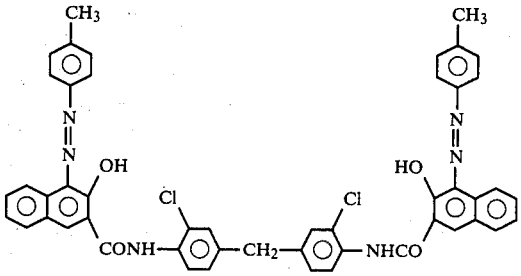

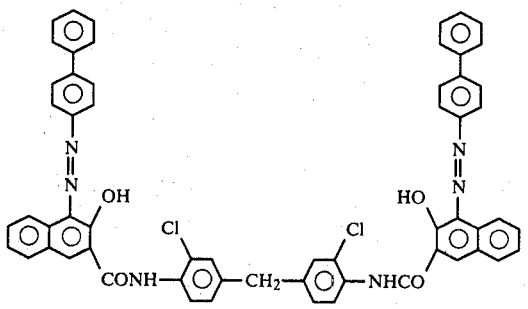

-continued
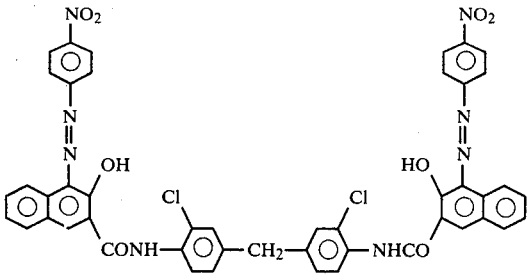
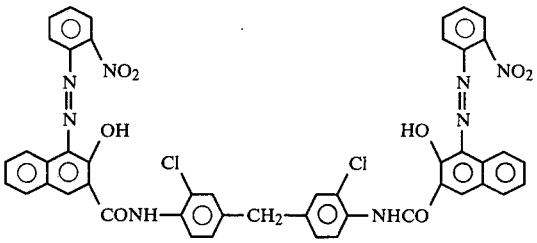
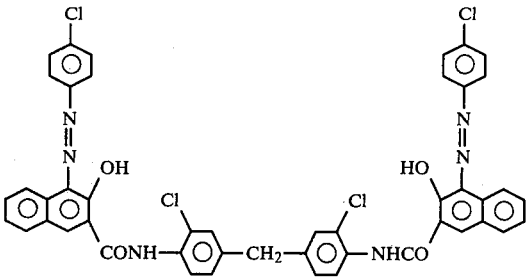
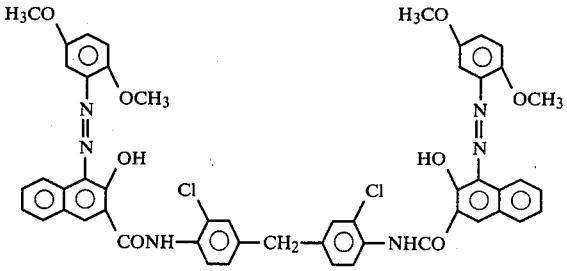
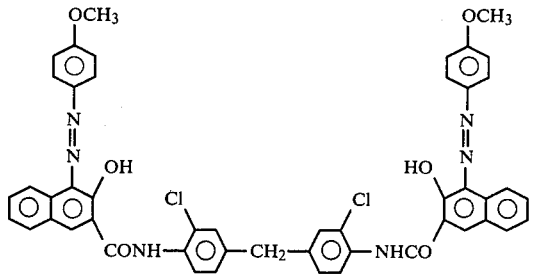
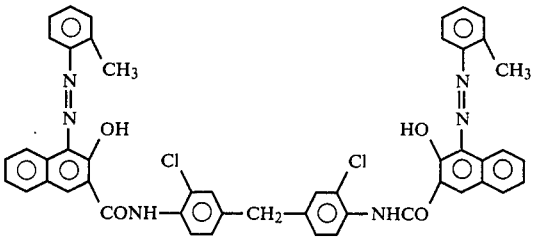
-continued
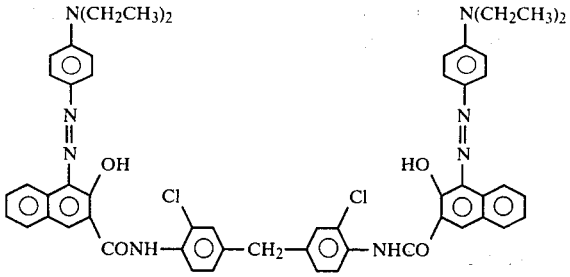
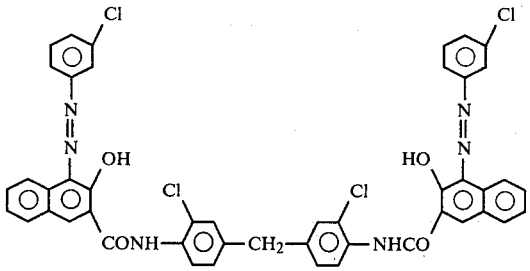
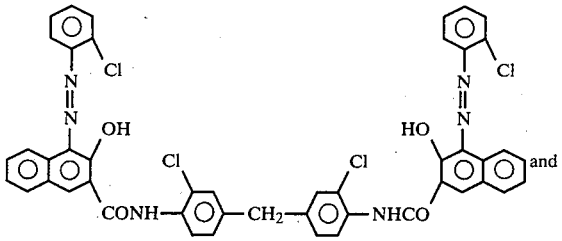
and
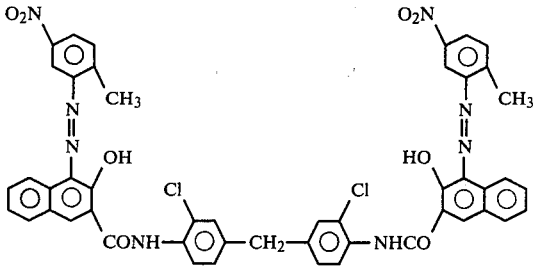
10. An electrophotographic element set forth in claim 8 in which the charge generation layer comprises a disazo pigment selected from the group consisting of
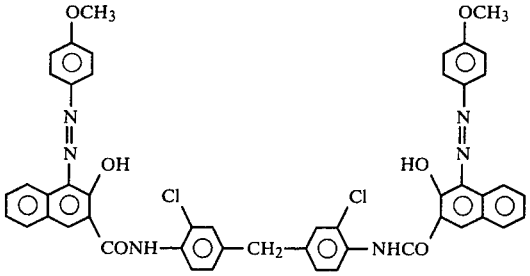
and
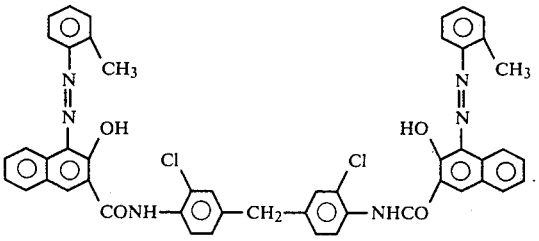

11. An electrophotographic element as set forth in claim 8 in which the polymeric binder is selected from the group consisting of polycarbonate resins, polystyrene, polyester resins, polyvinyl acetal, polyacrylates, polymethylmethacrylate and mixtures thereof.

12. An electrophotographic element as set forth in claim 8 in which said charge generation layer contains from 30 to 100% by weight of said disazo pigment and said charge transfer layer contains from 10 to 95% by weight of said charge transport.

13. An electrophotographic element comprising;

an electrically conductive layer;

and a photosensitive layer on the electrically conductive layer, the photosensitive layer having a thickness of from 3μ to 50μ and comprising particles of a disazo pigment, a charge transport material and a polymeric binder, said disazo pigment having a particle size of 5μ or less and having the formula;

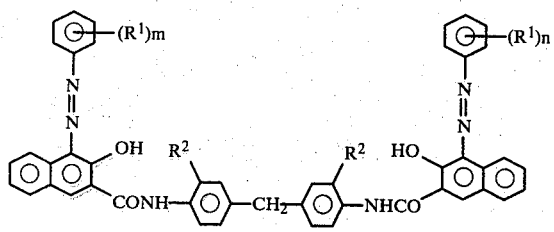

wherein $R^1$ is hydrogen, chlorine, bromine, methyl, ethyl, methoxy, ethoxy, nitro, dimethylamino, diethylamino or phenyl; m and n are each an integer of 1 or 2 and the $R^1$ groups are the same or different when m and n are 2; and $R^2$ is hydrogen or chlorine.

14. An electrophotographic element as set forth in claim 13 in which the disazo pigment contained in the photosensitive layer is selected from the group consisting of

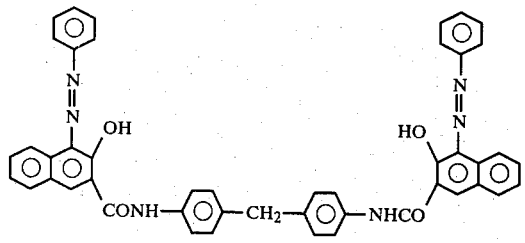

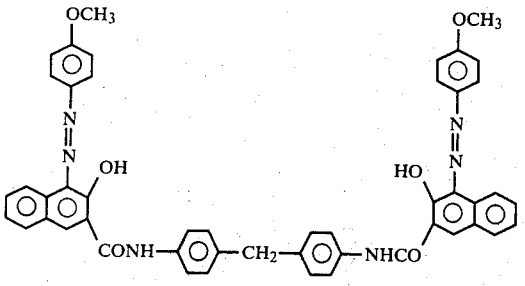

-continued

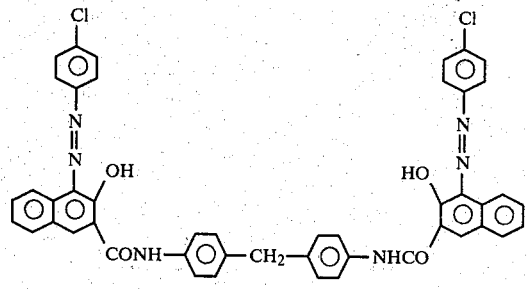

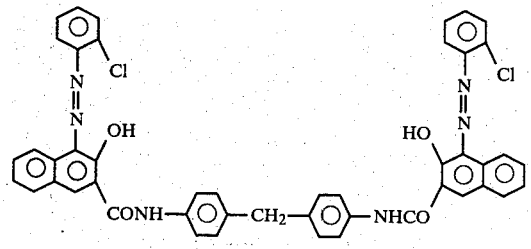

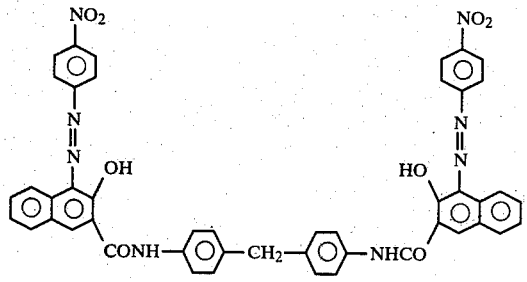

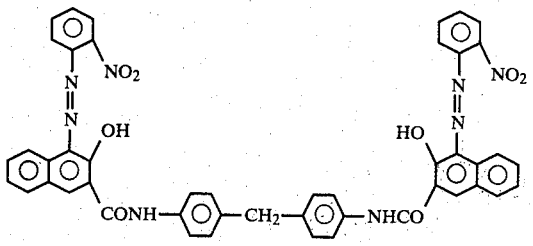

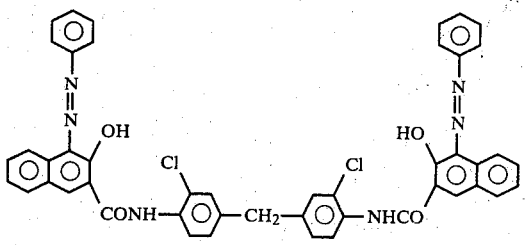

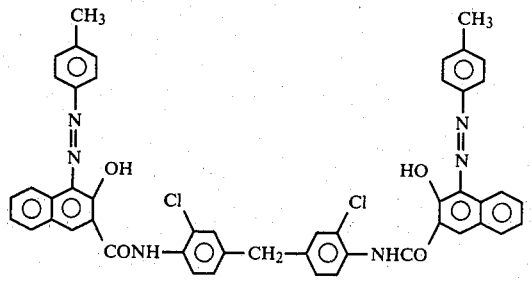

-continued
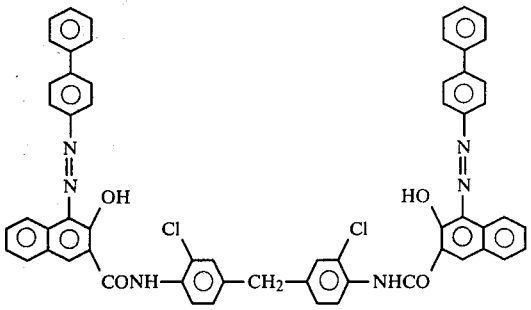
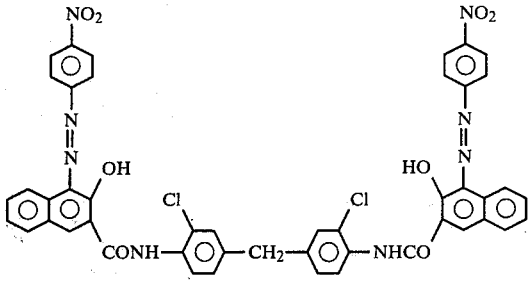
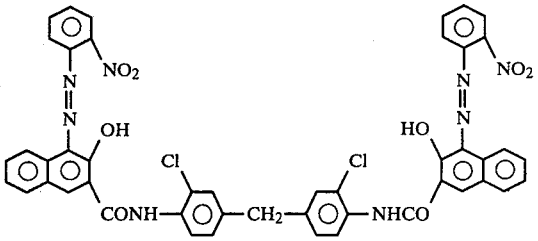
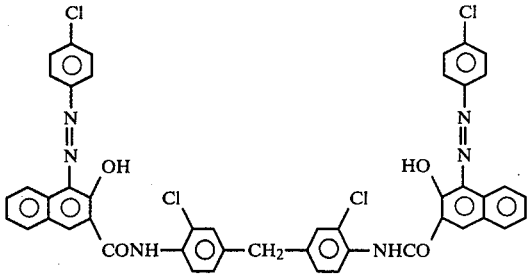
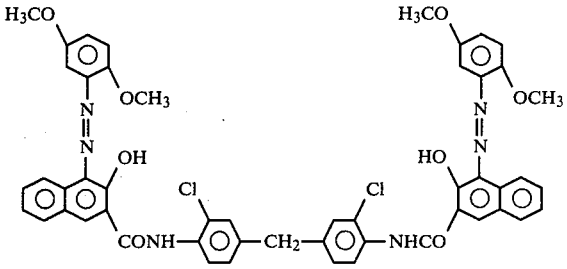
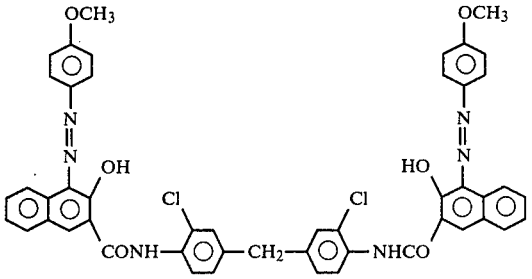
-continued
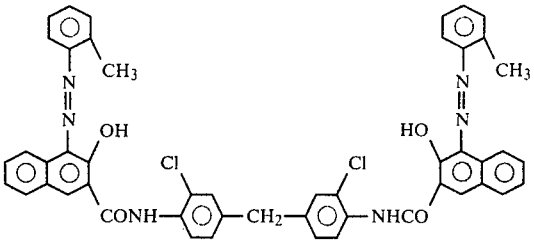
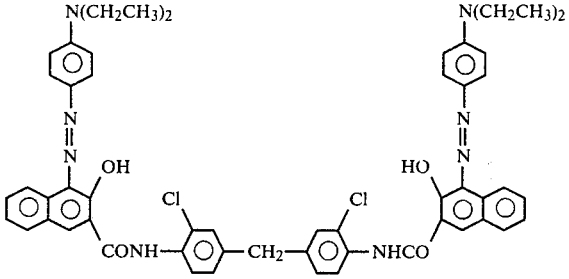
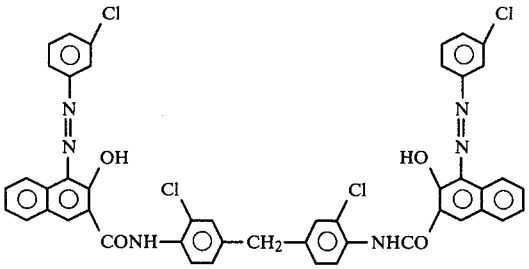
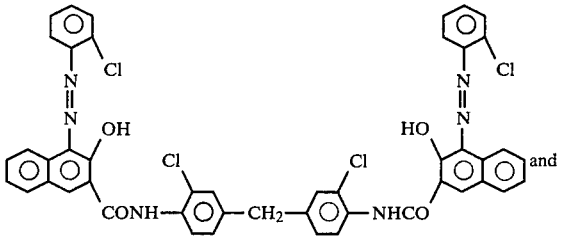
and
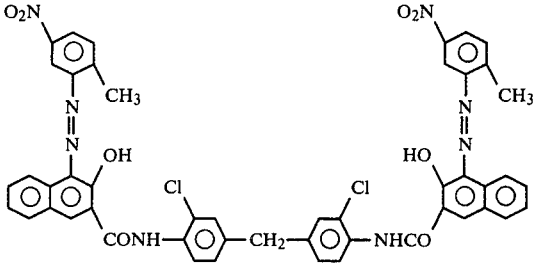
15. An electrophotographic element set forth in claim 13 in which the disazo pigment contained in the photosensitive layer is selected from the group consisting of
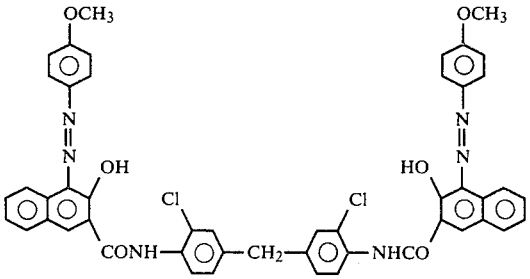
and -continued

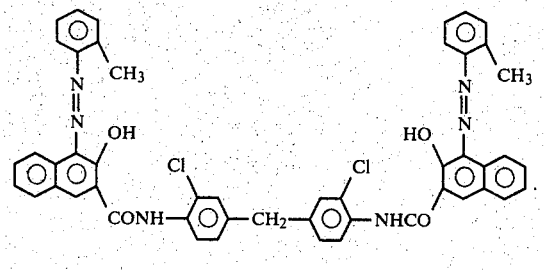

16. An electrophotographic element as set forth in claim 13 in which the photosensitive layer is of a thickness between 5 microns to 20 microns.

17. An electrophotographic element as set forth in claim 13 in which the charge transport material contained in the photosensitive layer comprises a compound selected from the group consisting of 9-(4-diethylaminostyryl)anthracene, 1,1-bis(4-dibenzylaminophenyl) propane, 1-phenyl-3-(4-diethylaminostyryl)-5-(4-diethylaminophenyl)pyrazoline and 9-ethyl-3-carbazolealdehyde-1-methyl-1-phenylhydrazone.

18. An electrophotographic element as set forth in claim 13 in which the polymeric binder is selected from the group consisting of polycarbonate resins, polystyrene, polyester resins, polyvinyl acetal, polyacrylates, polyethylmethacrylate and mixtures thereof.

19. An electrophotographic element as set forth in claim 13 in which said photosensitive layer contains from 0.1 to 50% by weight of said disazo pigment and from 30 to 90% by weight of said charge transport material.

20. An electrophotographic element comprising;

an electrically conductive substrate;

and a photosensitive layer responsive to actinic radiation of a wave length shorter than 6000 angstroms to generate an electronhole pair; said photosensitive layer having a thickness of from 3μ to 50μ and being comprised of particles of a disazo pigment, a charge transport material and a polymeric binder, the disazo pigment having a particle size of 5μ or less and having the formula;

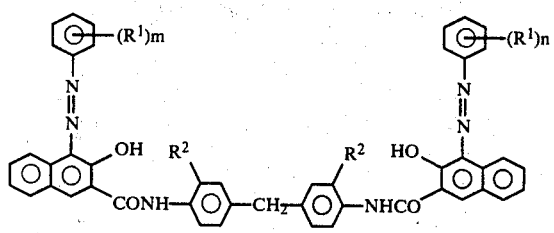

wherein $R^1$ is hydrogen, chlorine, bromine, methyl, ethyl, methoxy, ethoxy, nitro, dimethylamino, diethylamino or phenyl; m and n are each an integer of 1 or 2 and the $R^1$ groups are the same or different when m and n are 2; and $R^2$ is hydrogen or chlorine, the charge transport material being a member selected from the group consisting of 9-(4-diethylaminostyryl-)anthracene, 1,1-bis-(4-dibenzylaminophenyl)propane, 1-phenyl-3-(4-diethylaminostyryl-5-(4-diethylaminophenyl)pyrazoline and 9-ethyl-3-carbazolealdehyde-1-methyl-1-phenylhydrazone.

21. An electrophotographic element set forth in claim 20 in which the charge generation material is a disazo pigment selected from the group consisting of

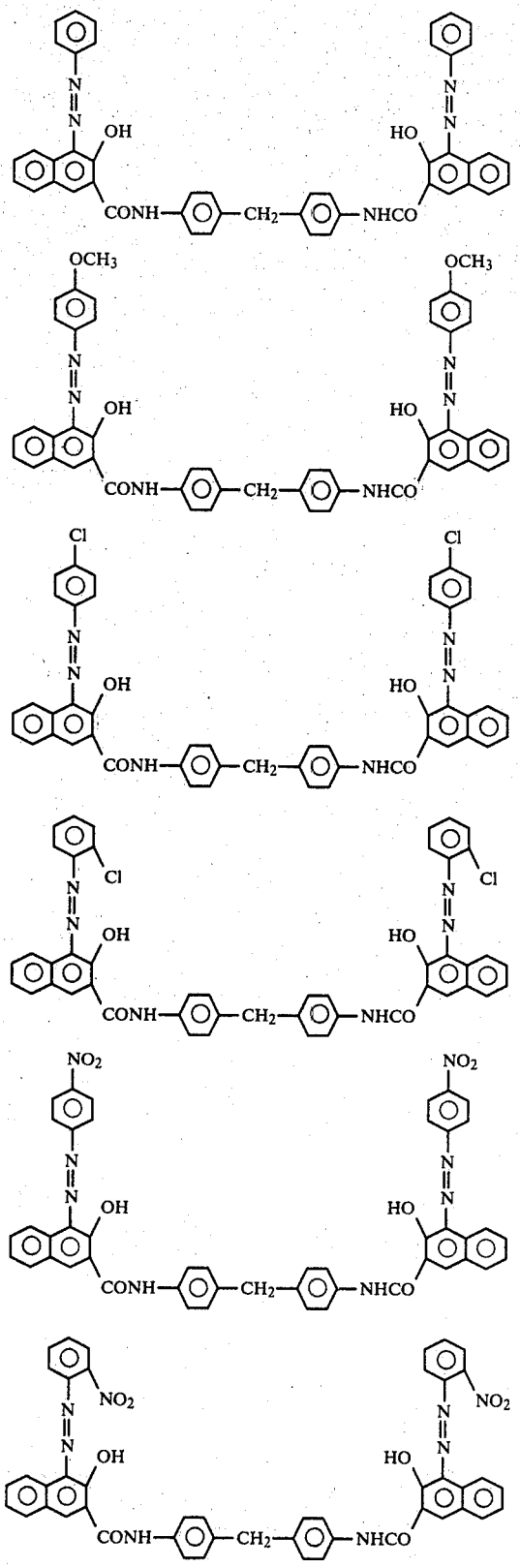

-continued
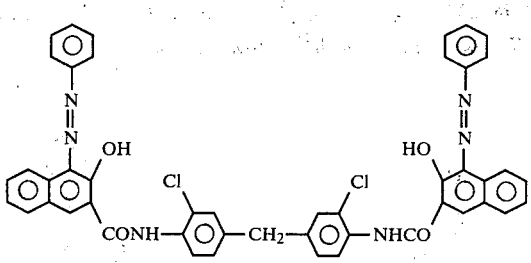
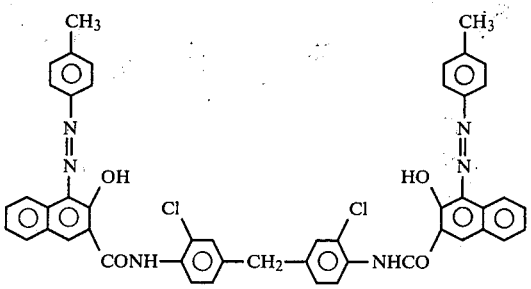
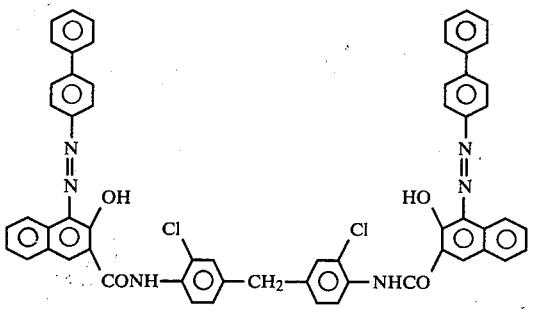
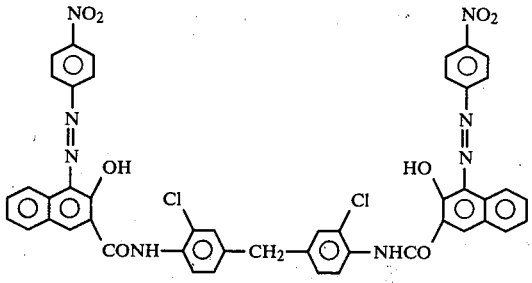
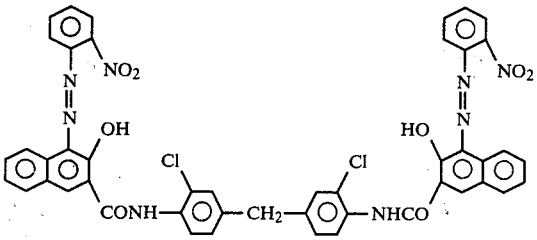
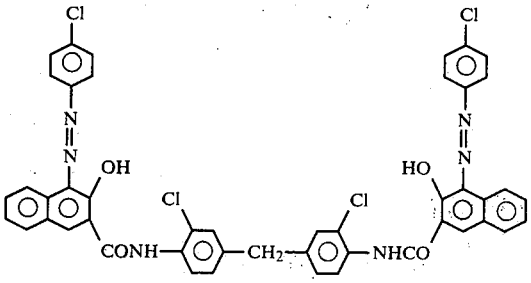
-continued
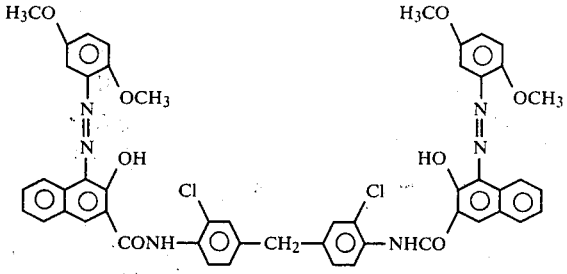
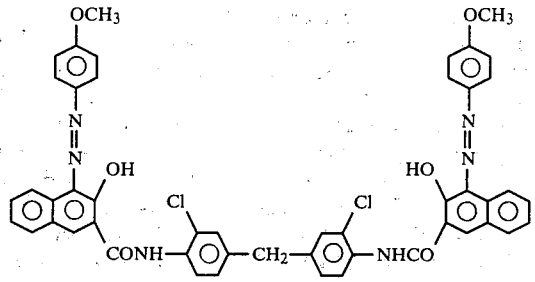
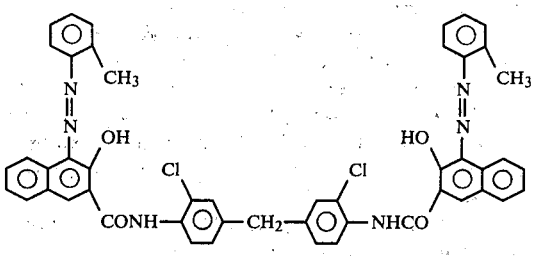
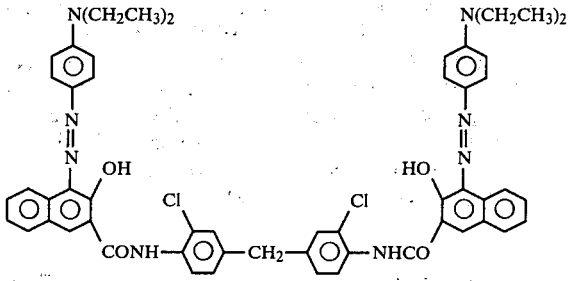
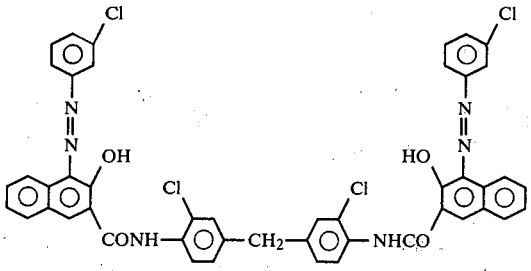
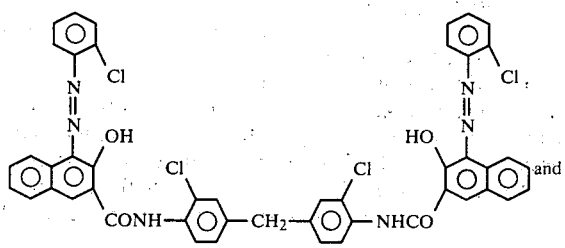
and -continued

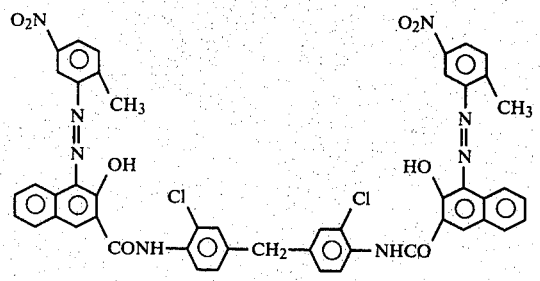

22. An electrophotographic element set forth in claim 20 in which the charge generation material is selected from the group consisting of

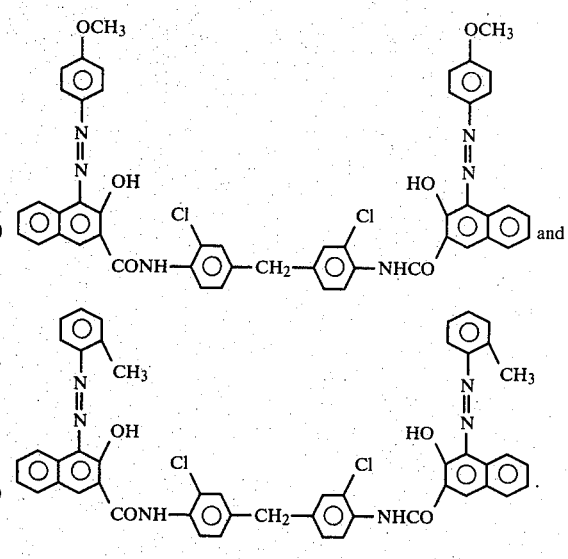

23. An electrophotographic element as set forth in claim 20 in which the polymeric binder is selected from the group consisting of polycarbonate resins, polystyrene, polyester resins, polyvinyl acetal, polyacrylates, polymethylmethacrylate and mixtures thereof.

24. An electrophotographic element as set forth in claim 20 in which said photosensitive layer contains from 0.1 to 50% by weight of said disazo pigment and from 30 to 90% by weight of said charge transport material.

* * * * *